US006365568B1

(12) United States Patent
Olson et al.

(10) Patent No.: US 6,365,568 B1
(45) Date of Patent: Apr. 2, 2002

(54) PROCESS FOR MANUFACTURING SOLID CAST SILICATE-BASED DETERGENT COMPOSITIONS AND RESULTANT PRODUCT

(75) Inventors: Keith Edward Olson, Apple Valley; Tom R. Oakes, Lake Elmo; Dan N. Tallman, Roseville; Bill George Mizuno, Golden Valley, all of MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 08/224,063

(22) Filed: Apr. 7, 1994

Related U.S. Application Data

(63) Continuation of application No. 07/894,164, filed on Jun. 3, 1992, now abandoned, which is a continuation of application No. 07/647,534, filed on Jan. 29, 1991, now abandoned.

(51) Int. Cl.[7] ..... C11D 17/06; C11D 3/08; C11D 7/14

(52) U.S. Cl. ..... 510/511; 510/445; 510/460; 510/466; 510/486

(58) Field of Search ..... 252/135, 174, 252/156, 160, 90, 99; 510/445, 460, 466, 486, 511

(56) References Cited

U.S. PATENT DOCUMENTS

| | | | | |
|---|---|---|---|---|
| 2,164,092 A | 6/1939 | Smith | ..... | 223/107 |
| 2,412,819 A | 12/1946 | MacMahon | ..... | 252/138 |
| 2,824,786 A | 2/1958 | Merlub-Sobel | ..... | 23/107 |

(List continued on next page.)

FOREIGN PATENT DOCUMENTS

DE 3519353 * 12/1986

OTHER PUBLICATIONS

Triton® Low–Foam Surfactants Product Bulletin CS–60b Feb. 1989.

Triton® CF–32 Product Bulletin CS–432 Sep. 1982.

Triton® CF–76 Product Bulleting CS–413 Jan. 1985.

PQ Corporation Bulletin 17–101 No Date Given.

Securon™ 540 Bulletin No Date Given.

Kirk–Othmer, Encyclopedia of Chemical Technology, Sodium Hydroxide, 3rd Edition, vol. 1, pp. 740–758. No. Date Given.

Kirk–Othmer, Encyclopedia of Chemical Technology, Synthetic Inorganic Silicates, 3rd Edition, vol. 18, pp. 134–165. No Date Given.

Bahr, Peroxide Bleaching–Possibilities and Limitations in Cold–Pad Batch Processes, (1985). Mo Month Given.

*Primary Examiner*—Yogendra N. Gupta
*Assistant Examiner*—Brian Mruk
(74) *Attorney, Agent, or Firm*—Merchant & Gould P.C.

(57) ABSTRACT

The invention includes a process for manufacturing an improved solid cast alkaline composition, that includes (a) reacting an alkali metal silicate with an alkali metal hydroxide of the formula MOH, where M is an alkali metal, in an aqueous environment to form a reaction product; and (b) solidifying the reaction product in a mold where the reaction product is formed and solidified at room temperature without the addition of externally supplied heat and the reaction product solidifies without the use of external cooling; and where the relative amount of alkali metal silicate, alkali metal hydroxide and water incorporated into the composition are effective for producing a reaction product having about 20 to 50 parts water per 100 parts of a combination of the alkali metal silicate, the alkali metal hydroxide and water in the cast solid composition and an $M_2O:SiO_2$ ratio of about 2.5:1 to 4.0:1 and M is an alkali metal; and where the process does not result in the deactivation of desirable operative cleaning components.

5 Claims, 6 Drawing Sheets

U.S. PATENT DOCUMENTS

| | | | | | |
|---|---|---|---|---|---|
| 3,231,505 | A | | 1/1966 | Farrar et al. | 252/138 |
| 3,231,506 | A | | 1/1966 | Schulerud et al. | 252/138 |
| 3,557,003 | A | | 1/1971 | Morris et al. | 252/90 |
| 3,649,545 | A | | 3/1972 | Susuki et al. | 252/174 |
| 3,748,103 | A | | 7/1973 | Bean et al. | 23/313 |
| 4,219,436 | A | | 8/1980 | Gromer et al. | 252/135 |
| 4,289,643 | A | | 9/1981 | Joubert et al. | 252/103 |
| 4,298,493 | A | | 11/1981 | Schreiber et al. | 252/135 |
| 4,362,640 | A | | 12/1982 | Schreiber et al. | 252/135 |
| 4,367,073 | A | | 1/1983 | Just et al. | 23/302 |
| 4,520,001 | A | | 5/1985 | Metzger et al. | 423/332 |
| 4,569,780 | A | | 2/1986 | Fernholz et al. | 252/90 |
| 4,578,258 | A | | 3/1986 | Rieck et al. | 423/325 |
| 4,595,520 | A | * | 6/1986 | Heile | 252/135 |
| 4,680,134 | A | * | 7/1987 | Heile | 252/160 |
| 4,681,914 | A | * | 7/1987 | Olson | 252/92 |
| 4,690,770 | A | | 9/1987 | Jeschke et al. | 252/99 |
| 4,725,376 | A | | 2/1988 | Copeland et al. | 252/90 |
| 4,753,755 | A | | 6/1988 | Gansser et al. | 252/527 |
| 4,774,014 | A | | 9/1988 | Kuenzel et al. | 252/90 |
| RE32,763 | E | * | 10/1988 | Fernholtz | 252/99 |
| RE32,818 | E | * | 1/1989 | Fernholtz | 252/99 |
| 4,846,993 | A | | 7/1989 | Lentsch et al. | 252/95 |
| 4,919,845 | A | | 4/1990 | Vogt et al. | 252/526 |
| 4,933,102 | A | * | 6/1990 | Olson | 252/174 |
| 5,064,554 | A | | 11/1991 | Jacobs et al. | 252/99 |

* cited by examiner

RUN #

MELT/DECOMPOSITION TEMP (°C)

MAXIMUM PROCESSING TEMP (°C)

(Tmelt – Tmax)

SOLIDIFICATION TIME (MIN)

PROCESS FOR MANUFACTURING SOLID CAST SILICATE-BASED DETERGENT COMPOSITIONS AND RESULTANT PRODUCT

This is a continuation application of prior application Ser. No. 07/894,164, filed on Jun. 3, 1992, which is a continuation of prior application Ser. No. 07/647,534 filed on Jan. 29, 1991 both abandoned.

A process for producing a solid cast silicate-based cleaning compositions which includes the step of combining appropriate concentrations of an alkali metal silicate, an alkali metal hydroxide and a source of water to form a reaction mixture that solidifies into a reaction product which is processable at temperatures below the melting point or decomposition temperature of the reaction product. The process provides for the rapid manufacture of a solid cast alkaline cleaning composition without melting of the cast composition. Incorporation of appropriate amounts of a combination of a polyacrylate and a phosphonate into the cleaning composition cooperate with the silicate present in the composition to form a threshold system which is effective for controlling precipitation of both calcium and magnesium in a use solution.

FIELD OF THE INVENTION

The invention relates to solid, cast, silicate-based detergent compositions, methods of manufacturing such compositions, and threshold systems useful in such compositions. Specifically, the invention relates to methods of manufacturing substantially uniformly dispersed, solid, cast, silicate-based, alkaline detergent compositions which do not require "melting" of any component the reaction mixture or the reaction product and which can include an effective threshold system.

BACKGROUND OF THE INVENTION

The advent of solid cast detergent compositions has revolutionized the manner in which detergents are dispensed by commercial and institutional entities which routinely use large quantities of cleaning solution. Prior to the advent of solid cast detergents, commercial and institutional entities were limited to either liquid, granular or pellet forms of detergent. However, because of the numerous unique advantages offered by solid cast detergents, the solid cast detergents, such as those disclosed in U.S. Pat. Nos. Re. 32,763, Re. 32,818, 4,680,134 and 4,595,520 quickly replaced the conventional liquid and granular detergents in the commercial and institutional markets.

The unique advantages offered by solid cast detergents include improved handling resulting in enhanced safety, elimination of component segregation during transportation and storage, increased concentration of active ingredients within the composition, and various others.

One method of manufacturing solid cast detergent compositions involves the steps of forming a homogenous melt of the detergent composition, casting the molten melt into a mold, and solidifying the melt by cooling.

Fernholz et al., U.S. Reissue Pat. No. 32,763 describes a method of manufacturing a solid cast detergent composition which involves the steps of (i) forming an aqueous solution of two hydratable chemicals, such as sodium hydroxide and sodium tripolyphosphate, (ii) heating the solution to a temperature of about 65° to 85° C., (iii) increasing the concentration of hydratable chemicals in the heated solution to produce a solution which is liquid at the elevated temperature but will solidify when cooled to room temperature, and (iv) casting the heated solution into molds for cooling and solidification.

While the solid cast detergents manufactured in accordance with the molten processes constitute a significant improvement over the previously known liquid and granular detergent compositions, the molten process is time consuming, requires large quantities of energy, and can result in deactivation of desirable operative cleaning components incorporated into the detergent such as bleaches, defoaming agents, enzymes, and tripolyphosphates if processing parameters are not closely monitored.

One effort to simplify and improve the molten process is disclosed in Copeland, et. al., U.S. Pat. No. 4,725,376 The Copeland patent describes a method of manufacturing a solid cast alkaline detergent composition capable of decreasing the extent of deactivation resulting from the manufacturing process. Briefly, the process disclosed by Copeland involves pouring an aqueous melt of a hydratable, alkaline, detergent component into a mold containing solid particles of a thermally-deactivatable detergent component such that the aqueous melt percolates through the interstitial void volume between the solid particles and-then solidifies to form a solid cast detergent composition containing homogeneously dispersed granules of the thermally-deactivatable detergent.

Gansser, U.S. Pat. No. 4,753,755, discloses a method for producing a solid alkaline detergent composition similar in mechanism to Fernholz et al.

Smith, U.S. Pat. No. 2,164,092, discloses a method for solidifying an aqueous alkaline solution by incorporating a metaphosphate into the alkaline solution under conditions capable of converting the metaphosphate to an orthophosphate and/or pyrophosphate with accompanying dehydration and solidification of the aqueous mixture.

While the processes disclosed by Gansser and Smith provide for the manufacture of solid cast detergent compositions, the process of Gannser additionally results in reaction mixtures which generally take several hours to solidify and require prolonged agitation to prevent segregation while the process of Smith is limited to phosphate-based detergents.

Accordingly, a substantial need exists for additional manufacturing techniques which can provide for the formation of solid cast detergent compositions without requiring the attainment of melt/decomposition temperatures.

SUMMARY OF THE INVENTION

The invention is broadly directed to a cast solid composition and methods for the production of solid cast silicate-based cleaning compositions which do not require melt phase processing. Specifically, the invention provides for the production of solid cast silicate-based cleaning compositions which rapidly solidify substantially simultaneously across the entire cross section of the reaction product. In the process, as a result of mixing and under conditions of mixing, a thermodynamically unstable liquid mixture is formed that can rapidly solidify into a thermodynamically stable solid. Because the cleaning composition includes silicate as the source of alkalinity, a synergistically effective threshold system may be incorporated into the composition for the purpose of preventing the precipitation of both calcium and magnesium ions.

The process combines appropriate concentrations of an alkali metal silicate or mixtures of silicates, an alkali metal hydroxide and a source of water to create a liquid or fluid reaction mixture which is processable at temperatures below the melting point or decomposition temperature of the reaction product and which forms a reaction product which is solid under processing conditions.

The product of the process of the invention typically comprises a hydrated silicate containing composition or mixtures of a hydrated silicate species thereof. The hydrated silicate materials can contain additional amounts of concentrated sodium hydroxide as part of the solid matrix. In the solidification processes involved in the invention, a silicate composition, optionally another silicate species, and sodium hydroxide, interact with a wash chemical to form a liquid reaction mixture that is thermodynamically unstable which becomes thermodynamically stable through a solidification process. In the solidification process, the materials react to alter the normaly fluid constituent ratios to different ratios that are normally solid at ambient temperatures. In such reactions, we have found that most processing mixtures with common ratios of ingredients, that two or more discrete hydration states are formed in the reaction product. We have found that the production of two or more hydration states can be characteristic of products made with this reaction. It should be understood that at certain "perfect" ingredient ratios, single hydration states can be formed. However, under most processing conditions and combinations of ingredients, two, three or more, discrete hydration states can be formed. Such hydration states can be identified using differential scanning calorimetry (DSC) wherein each hydration has its characteristic temperature on a DSC curve, each hydration having a peak in the curve at differing temperatures.

Definitions

As used herein, including the claims, the term "ambient" refers to those temperatures (about 10° C. to about 50° C.) and pressures (about 700 to 900 mm Hg) typically encountered in the environment.

As used herein, including the claims, the term "cleaning composition" refers to multiple component substances which are useful in cleaning surfaces and substrates.

As used herein, including the claims, the term "cleaning solution" refers to an aqueous solution containing a sufficient quantity of a cleaning composition to be effective for cleaning surfaces and substrates.

As used herein, including the claims, the term "wash chemical" or "operative cleaning component" refers to components which can enhance the cleaning ability of a cleaning composition. Operative cleaning component includes specifically, but not exclusively: sources of alkali such as an alkali metal hydroxide, an alkali metal silicate, anti-redeposition agents, bleaches, enzymes, sequestrants, surfactants, and threshold agents or systems. When used in the claims, a wash chemical, when combined with a first form of silicate, refers to a second different silicate composition or form. In other words, the different silicate is a silicate that differs in $Na_2O:SiO_2$ ratio.

As used herein, including the claims, the terms "deactivate" and "deactivation" refer to a reduction or elimination in a useful chemical property or characteristic through chemical modification.

As used herein, including the claims, the term "melting point or decomposition temperature", refers to the temperature at which a solid substance begins to melt or decompose the hydrate e.g. evaporate or drive off water. The solid silicate systems of this invention are considered to possess a melt temperature if they pass from a solid to a liquid at a temperature below the boiling point of water such that the water portion of the composition remains in the heated composition and are considered to possess a decomposition temperature if they melt at a temperature above the boiling point of water such that the water portion of the composition leaves the heated composition as stem.

As used herein, including the claims, the term "externally supplied heat" refers to the intentional addition of heat to a system from a separate and independent heat source such as steam and specifically excludes the addition of heat to a system caused by variances in ambient conditions and exothermic reactions occurring between reactants in the system.

As used herein, including the claims, the term "formulation" refers to the chemical composition or constitution of a substance. The formulation of a mixture is defined by the amount and composition of each ingredient.

As used herein, including the claims, the term "processable" means having sufficient fluidity or sufficiently low viscosity to be stirred, mixed, agitated, blended, poured, and/or molded in common industrial mixing equipment.

As used herein, including the claims, the term "process conditions" refers to the product temperatures and pressures encountered during processing.

As used herein, including the claims, the term "reaction mixture" refers to a mixture of reactants prior to conversion of a meaningful proportion of the reactants to a reaction product.

As used herein, including the claims, the term "meaningful proportion", when used in connection with "reaction mixture", means a proportion sufficient to perceptibly alter the physical characteristics of the mixture or to introduce a desirable cleaning property to the cast material such as detergency, hardness sequestering, soil anti-redeposition, etc.

As used herein, including the claims, the term "reaction product" refers to the composition resulting from completion of the solidification of a reaction mixture.

As used herein, including the claims, the term "room temperature" refers to the temperature typically maintained in an environmentally controlled living space (about 15° C. to about 32° C.).

As used herein, including the claims, the term "solid" refers to a substance which will not flow perceptibly under moderate stress. Specifically, a cast substance is deemed to be "solid" when the substance will retain the shape of the mold when removed from the mold.

As used herein, including the claims, the term "stoichiometric excess" refers to an amount of a chemical reactant which exceeds that necessary to convert all other reactants to product based upon the quantitative chemical relationship of the reactants. For example, a combination of 10 moles of hydrogen and 4 moles of oxygen to form $H_2O$ includes a stoichiometric excess of 2 moles of hydrogen.

As used herein, including the claims, the term "supercooled" refers to a condition of thermodynamic instability caused by the existence of a liquid system at a temperature below the freezing point of that system.

As used herein, including the claims, the term "thermodynamic stability" refers to a condition of thermodynamic equilibrium.

As used herein, including the claims, the term "thermodynamically unstable" refers to a thermodynamic situation where either the physical or chemical state of a liquid system has not achieved thermodynamic equilibrium and the instability created by mixing liquid components is released by the solidification of the unstable liquid, and the gain or loss of a heat of solidification.

As used herein, including the claims, the term "threshold agent" or "threshold system" refers to those compounds or combination of compounds which exhibit the ability to prevent the precipitation of hardness ions from an aqueous system at a concentration which is significantly less than the concentration of hardness ions in the aqueous system.

As used herein, the term "wt % water" refers to all water contained in the composition and specifically includes both free and chemically bound water regardless of source.

As used herein, the term "wt %" is based upon the amount of alkali metal silicate, alkali metal hydroxide and water in the reaction mixture unless otherwise specified.

DETAILED DESCRIPTION OF THE INVENTION INCLUDING A BEST MODE

Figure 1:
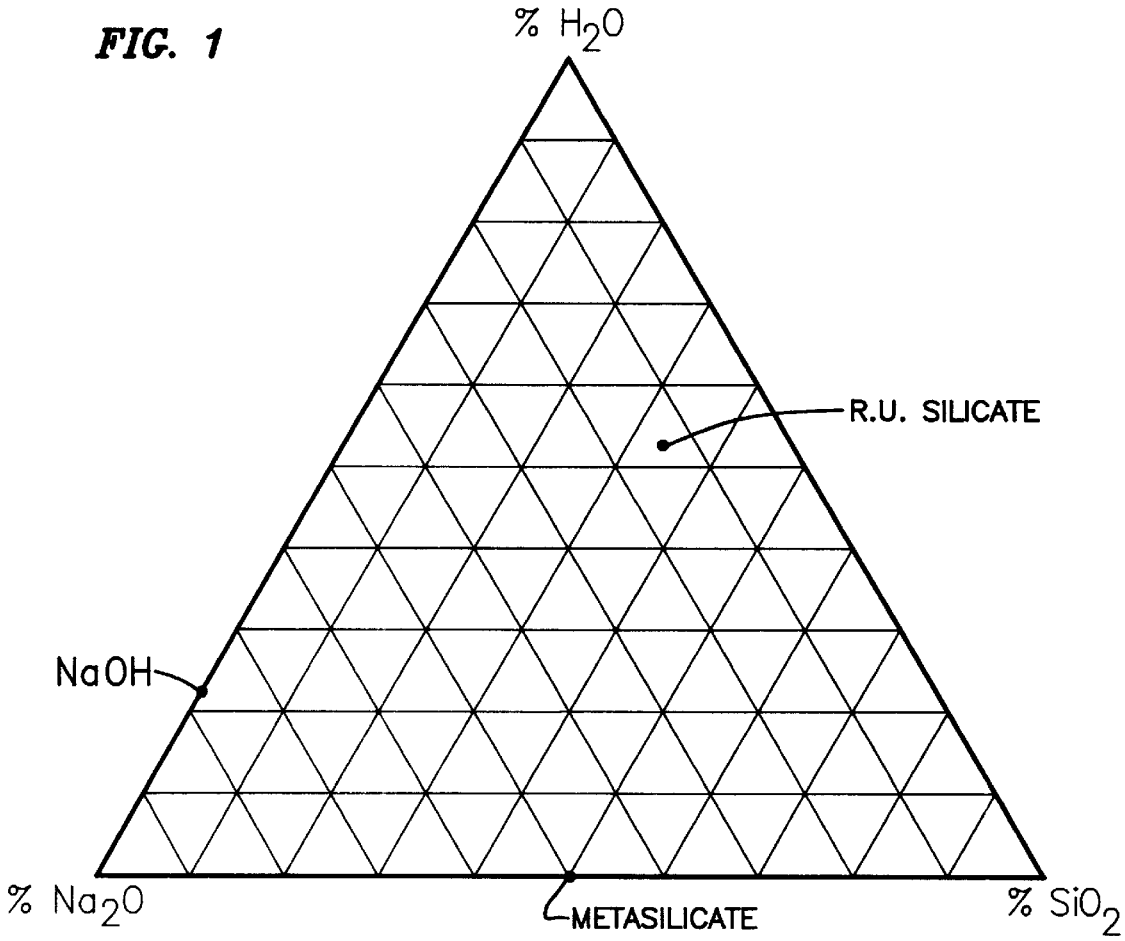
FIG. 1 is a ternary diagram depicting the $H_2O$, $Na_2O$ and $SiO_2$ composition of selected reagents used in Experimental Trials 30–57 set forth in the Application.
Figure 2:
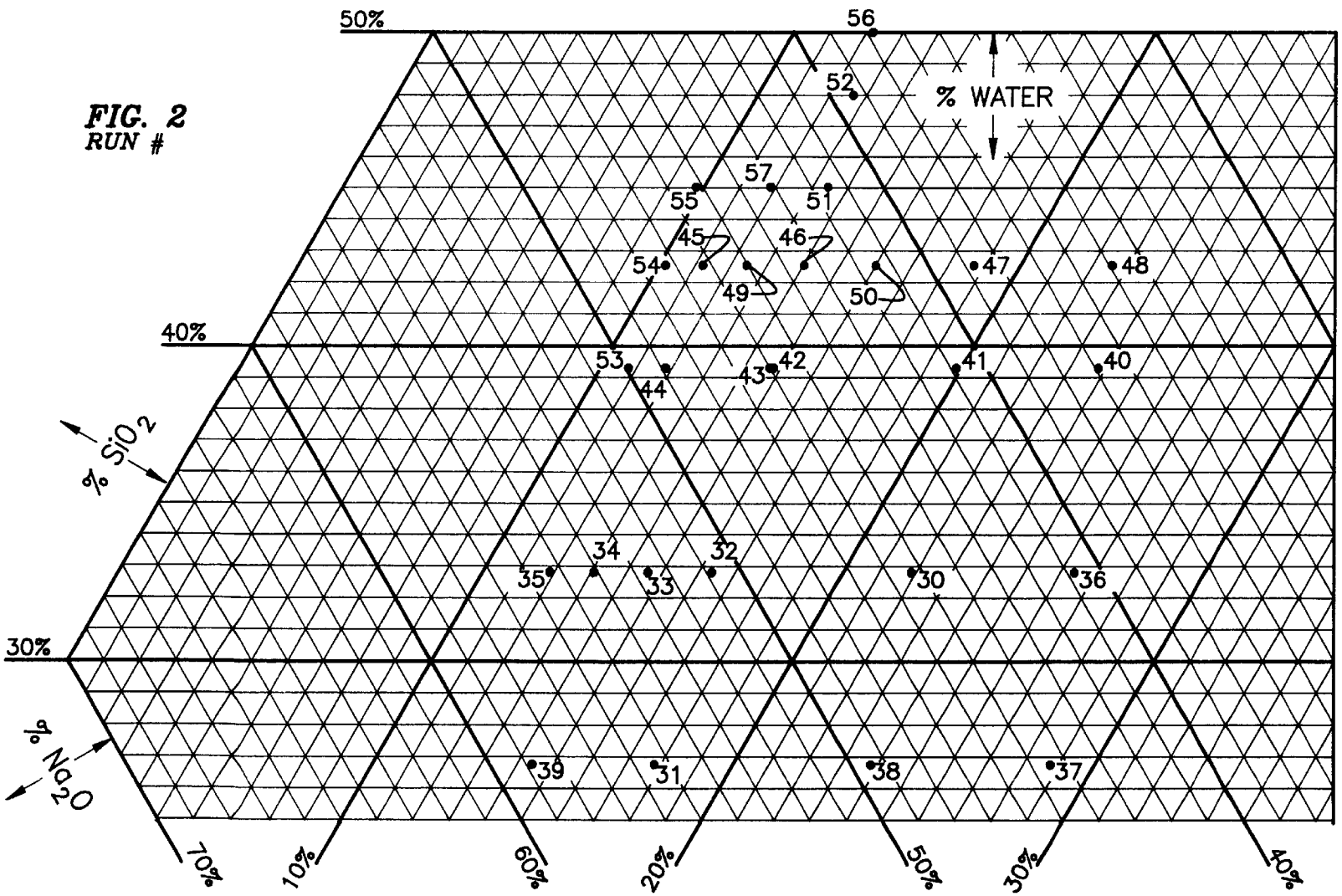
FIG. 2 is a portion of a ternary diagram depicting the $H_2O$, $Na_2O$ and $SiO_2$ composition of the products obtained from Experimental Trials 30–57.

A silicate-based alkaline cleaning composition which is solid under ambient conditions may be manufactured without heating the reaction mixture above the melt/decomposition temperature of the reaction mixture or reaction product by employing a solidification system including an alkali metal silicate, optionally, an alkali metal hydroxide, and water. Preferably, the alkali metal of the silicate and the alkali metal of the hydroxide are identical. An alkali metal silicate when reacted with another cast chemical, such as a different alkali metal silicate, and other optional wash chemicals, can become unstable in alkaline solution or suspension and can solidify. Because of low cost and ready availability, the sodium silicate and sodium hydroxide species are preferred. Accordingly, without intending to be limited thereby, the remainder of the specification will describe the invention in terms of sodium silicate and sodium hydroxide.

A mixture of a sodium silicate species and a second wash chemical such as a different sodium silicate, a phosphate, etc., with an amount of sodium hydroxide, can exothermically react in accordance with Equation 1 to increase the $Na_2O$ content (alkalinity) of the silicate.

$$xNaOH+ySiO_2{:}zNa_2O=ySiO_2{:}(z+0.5x)Na_2O+(0.5x)H_2O \quad \text{(Equation 1)}$$

Controlled increases in the alkalinity of a silicate solution can transform the silicate solution from a system which is liquid under ambient conditions to a system which is solid under those same conditions.

Broadly, a substantially uniformly dispersed cleaning composition which is solid under ambient conditions may be manufactured without melting the reaction mixture or the reaction product by combining amounts of a sodium silicate or mixtures of silicates thereof, sodium hydroxide and water to achieve a reaction mixture containing about 20–45 wt % water and with an $Na_2O{:}SiO_2$ ratio of about 1:1 to 2.5:1; or amounts of sodium silicate or mixtures of silicates thereof, sodium hydroxide and about 20–50 wt % water and with an $Na_2O{:}SiO_2$ ratio of about 2.5:1 to 4:1. Specifically, a uniformly dispersed cleaning composition with a freezing point above about 70° C. may be quickly and easily manufactured without melting the reaction mixture or the reaction product by combining amounts of a sodium silicate or mixtures of silicates thereof, sodium hydroxide and water to achieve a reaction mixture containing about 20–40 wt % water with an $Na_2O{:}SiO_2$ ratio of about 1.5:1 to 2.5:1 or amounts of sodium silicate or mixtures of silicates thereof, sodium hydroxide and about 20–45 wt % water and with an $Na_2O{:}SiO_2$ ratio of about 2.5:1 to 3.5:1.

Reaction mixtures with too much water do not readily form a product which is solid at ambient conditions while mixtures with too little water are difficult to process because of their high viscosity. Reaction mixtures with an $Na_2O{:}SiO_2$ ratio which is too low have a melt/decomposition temperature which is too low to be of practical use while mixtures with an $Na_2O{:}SiO_2$ ratio which is too high do not readily form solids at ambient conditions and/or are difficult to manufacture without attaining melt/decomposition temperatures due to a combination of the low melt/decomposition temperatures of the reaction mixtures and the high process temperatures required.

One of the reactants in the reaction mixture is sodium silicate. Commercial sodium silicates are available in both powdered and liquid forms. The powdered forms include both amorphous and crystalline powders in either hydrated or anhydrous form. The aqueous liquids are available with viscosities ranging from 0.5 to 600,000 cP at 20° C. The potassium silicates are sold either as a glass or an aqueous liquid. The synthetic lithium silicates typically are sold only as liquids. Typical commercially available amorphous sodium and potassium silicates are listed in Tables 1 and 2. The more common commercially available sodium silicates vary in $Na_2O/SiO_2$ ratio from about 2:1 to about 1:4.

The solid forms are generally classified as to particle-size range and $Na_2O/SiO_2$ ratio.

The aqueous solutions can be specifically identified by any combination of density/specific gravity, alkali:silica ratio, and viscosity. Typically, the aqueous solutions are differentiated on the basis of specific gravity (° Baume) and $Na_2O/SiO_2$ ratio. Concentrated solutions of highly alkaline sodium silicates are quite sticky or tacky. Conversely, concentrated solutions of highly siliceous sodium silicate show little tack but are plastic enough to form into balls which show a surprising elasticity.

The crystalline products which are readily available on a commercial scale are the anhydrous and hydrated sodium metasilicates ($Na_2SiO_3$, $Na_2SiO_3.5H_2O$ and $Na_2SiO_3.9H_2O$) and the hydrated sodium sesquisilicates ($Na_2HSiO_4.5H_2O$ and $3Na_2O.2SiO_2.11H_2O$). The anhydrous sodium sesquisilicate and the technically anhydrous orthosilicates are also available but generally considered to be mixtures of caustic soda and sodium metasilicate. A listing of the physical properties of various crystalline alkali silicates is provided in Table 3.

The liquid products which are readily available on a commercial scale include $M_2O{:}SiO_2$ ratios from about 1:1.5 to 1:3.8 for sodium silicate and about 1:1.5 to about 1:2.5 for potassium silicate with a water content from about 45 to about 75 wt % based upon the weight of the silicate and the water.

TABLE 1

Commercial Solid Silicates

| Name | $M_2O:SiO_2$ (wt) | % $M_2O$ | % $SiO_2$ | % $H_2O$ | Softening Pt (° C.) | Flow Pt (° C.) |
|---|---|---|---|---|---|---|
| Sodium Silicate | 1:3.22 | 23.5 | 75.7 | — | 655 | 840 |
| (anhydrous glasses) | 1:2.00 | 33.0 | 66.0 | — | 590 | 760 |

TABLE 1-continued

Commercial Solid Silicates

| Name | $M_2O:SiO_2$ (wt) | % $M_2O$ | % $SiO_2$ | % $H_2O$ | Softening Pt (° C.) | Flow Pt (° C.) |
|---|---|---|---|---|---|---|
| Potassium Silicate (anhydrous glasses) | 1:2.50 | 28.3 | 70.7 | — | 700 | 905 |
| Sodium Silicates (hydrated amphorous powders) | 1:3.22 | 19.2 | 61.8 | 18.5 | — | — |
| | 1:2.00 | 27.0 | 54.0 | 18.5 | — | — |

TABLE 2

Commercial Liquid Silicates

| Name | ($M_2O:SiO_2$) (wt) | % $M_2O$ | % $SiO_2$ | Baume at 20° C. | Specific Gravity | Viscosity (Poise/20° C.) |
|---|---|---|---|---|---|---|
| Sodium Silicate (solutions) | 1:1.60 | 19.70 | 31.5 | 58.3 | 1.68 | 70.00 |
| | 1:2.00 | 18.00 | 36.0 | 59.3 | 1.69 | 700.00 |
| | 1:2.50 | 10.60 | 26.5 | 42.0 | 1.41 | 0.60 |
| | 1:2.88 | 11.00 | 31.7 | 47.0 | 1.49 | 9.60 |
| | 1:3.22 | 8.90 | 28.7 | 41.0 | 1.39 | 1.80 |
| | 1:3.75 | 6.80 | 25.3 | 35.0 | 1.32 | 2.20 |
| Potassium Silicate (solutions) | 1:2.50 | 8.30 | 20.8 | 29.8 | 1.26 | 0.40 |
| | 1:2.20 | 9.05 | 19.9 | 30.0 | 1.26 | 0.07 |
| | 1:2.10 | 12.50 | 26.3 | 40.0 | 1.38 | 10.50 |
| | 1:1.80 | 10.40 | 29.5 | 47.7 | 1.49 | 13.00 |
| Lithium Silicate (solutions) | 1:9.4 | 2.20 | 20.7 | — | — | — |
| | 1:9.6 | 2.10 | 20.0 | — | — | 4.00 |
| | 1:11.8 | 1.60 | 18.8 | — | — | — |
| | 1:17.0 | 1.20 | 20.0 | — | — | 2.50 |

TABLE 3

Physical Properties of Various Crystalline Alkali Silicates

| Name | Formula | Melting Point (° C.) | Density (g/ml) | ΔH cal/wt at 25° C. | Refractive Indexes alpha | beta | gamma |
|---|---|---|---|---|---|---|---|
| Sodium Orthosilicate | $Na_4SiO_4$ ($2Na_2O.SiO_2$) | 1118 | 2.50 | −497,800 | 1.524 | — | 1.537 |
| Sodium Sesquisilicate | $Na_6Si_2O_7$ ($3Na_2O \cdot 2SiO_2$) | 1122 | 2.96 | −856,300 | 1.524 | — | 1.529 |
| Sodium Sesquisilicate Pentahydrate | $Na_6Si_2O_7.5H_2O$ ($3Na_2O.2SiO_2.5H_2O$) | 88 | — | −1,648,000 | 1.502 | 1.510 | 1.524 |
| Sodium Metasilicate | $Na_2SiO_3$ ($Na_2O.SiO_2$) | 1089 | 2.614 | −364,700 | 1.490 | 1.500 | 1.510 |
| Sodium Metasilicate Pentahydrate | $Na_2SiO_3.5H_2O$ ($Na_2O.SiO_2.5H_2O$) | 72.2 | 1.749 | −722,100 | 1.447 | 1.454 | 1.467 |
| Sodium Metasilicate hexahydrate | $Na_2SiO_3.6H_2O$ ($Na_2O.SiO_2.6H_2O$) | 70<br>62.9 | 1.807 | −792,600 | 1.488<br>1.465 | —<br>1.475 | 1.495<br>1.465 |
| Sodium Metasilicate Octahydrate | $Na_2SiO_3.8H_2O$ ($Na_2O.SiO_2.8H_2O$) | 48.35 | 1.672 | −934,800 | 1.475 | 1.463 | 1.465 |
| Sodium Metasilicate Nanohydrate | $Na_2SiO_3.9H_2O$ ($Na_2O.SiO_2.9H_2O$) | 47.85 | 1.646 | −1,005,100 | 1.451 | 1.456 | 1.460 |
| Sodiuin | $Na_2Si_2O_5$ | 874 | 2.964 | −576,100 | 1.500 | 1.510 | 1.518 |

TABLE 3-continued

Physical Properties of Various Crystalline Alkali Silicates

| Name | Formula | Melting Point (° C.) | Density (g/ml) | ΔH cal/wt at 25° C. | Refractive Indexes alpha | beta | gamma |
|---|---|---|---|---|---|---|---|
| Disilicate | ($Na_2O.2SiO_2$) | | | | | | |
| Sodium Trisilicate | $Na_6Si_8O_{19}$ ($3Na_2O.8SiO_2$) | 808 | 2.470 | — | — | 1.503 | — |
| Sodium Tetrasilicate | $Na_2Si_4O_9$ ($Na_2O.4SiO_2$) | — | 1.130 | — | 1.471 | — | 1.485 |
| Potassium Metasilicate | $K_2SiO_3$ ($K_2O.SiO_2$) | 976 | — | — | 1.520 | — | 1.528 |
| Potassium Metasilicate Hemihydrate | $K_2SiO_3.½ H_2O$ ($K_2O.SiO_3.½ H_2O$) | Above 600 | — | — | — | 1.500 | — |
| Potassium Metasilicate Monohydrate | $K_2SiO.H_2O$ ($K_2O.SiO_2.H_2O$) | 370 | — | — | — | 1.500 | — |
| Potassium Disilicate | $K_2Si_2O_5$ ($K_2O.2SiO_2$) | 1045 | — | — | 1.503 | — | 1.513 |
| Potassium Disilicate Monohydrate | $K_2Si_2O.H_2O$ ($K_2O.2SiO_2.H_2O$) | 405 | — | — | — | 1.500 | — |
| Potassium Tetrasilicate | $K_2Si_4O_9$ ($K_2O.4SiO_2$) | 770 | 2.335 | −999,200 | 1.477 | — | 1.482 |
| Potassium Tetrasilicate Monohydrate | $K_2Si_4O_9.H_2O$ ($K_2O.4SiO_2.H_2O$) | 515 | 2.417 | — | 1.495 | 1.530 | 1.535 |

Soluble silicates produce useful cleaning compositions as they are capable of maintaining a sufficiently high pH throughout the system due to their buffering ability and can perform certain basic detersive functions such as saponification of animal and vegetable oils and fats, emulsification of mineral oils, deflocculation of solid dirt particles, suspension of soils, prevention of redeposition of suspended dirt, and inhibition of soft metal corrosion by other ingredients in the cleaning composition.

A second reactant in the reaction mixture is sodium hydroxide. Sodium hydroxide or caustic soda is a white deliquescent solid. Anhydrous caustic soda is very soluble in water and highly alkaline with a melting point of 318.4° C., a density at 20° C. of 2.130 g/ml, and a heat of fusion of 40.0 cal/gram. FIG. 1 provides a general ternary diagram of silicon dioxide-sodium hydroxide-water systems.

A first obligatory consideration in selecting a reaction mixture formulation is the processability of the reaction mixture. Processability of the reaction mixture is dependent upon a number of factors including the concentration of solids, (silicate, hydroxide and optional solid components) in the mixture [increased solids content decreases processability] and the temperature of the mixture [increased temperature increases processability].

Those reaction mixtures with a solids concentration of greater than about 80 wt % (water content of less than 20 wt %) are not readily processable because they are simply too thick to be properly mixed using standard mixing equipment. While it may be possible to process reaction mixtures having less than about 20 wt % water using specialized processing equipment, it is preferred to manufacture the product using a water content in excess of about 20 wt % in order to avoid the problems inherent in processing such highly viscous mixtures.

As a general matter, those reaction mixture formulations which satisfy the obligatory considerations of processability. and solidifiability pass through a temporary phase at which time they are highly processable.

Figure 3:
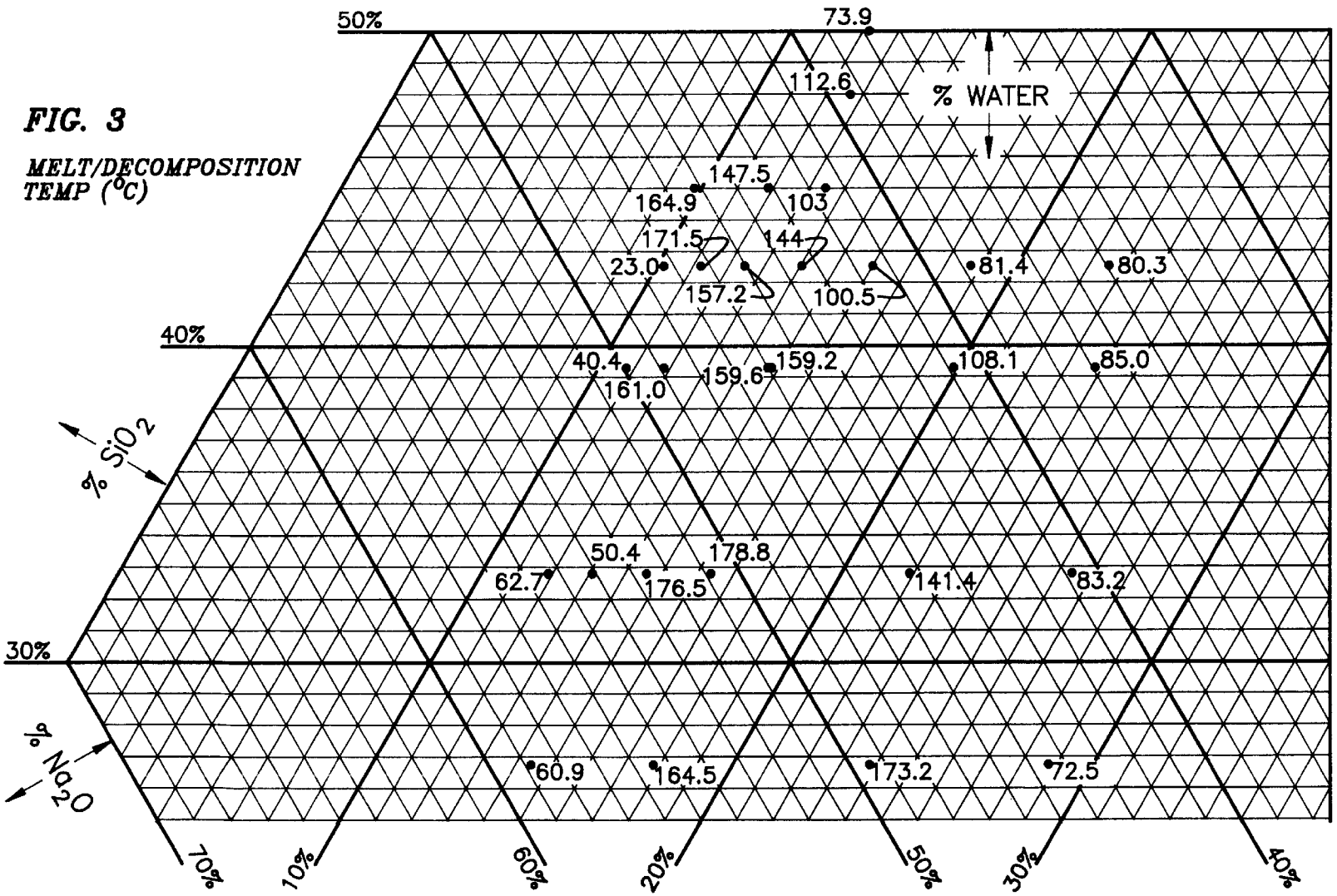
FIG. 3 is a portion of a ternary diagram depicting the melting point or decomposition temperature of the products obtained from Experimental Trials 30–57 based upon the $H_2O$, $Na_2O$ and $SiO_2$ composition of the product.
Figure 4:
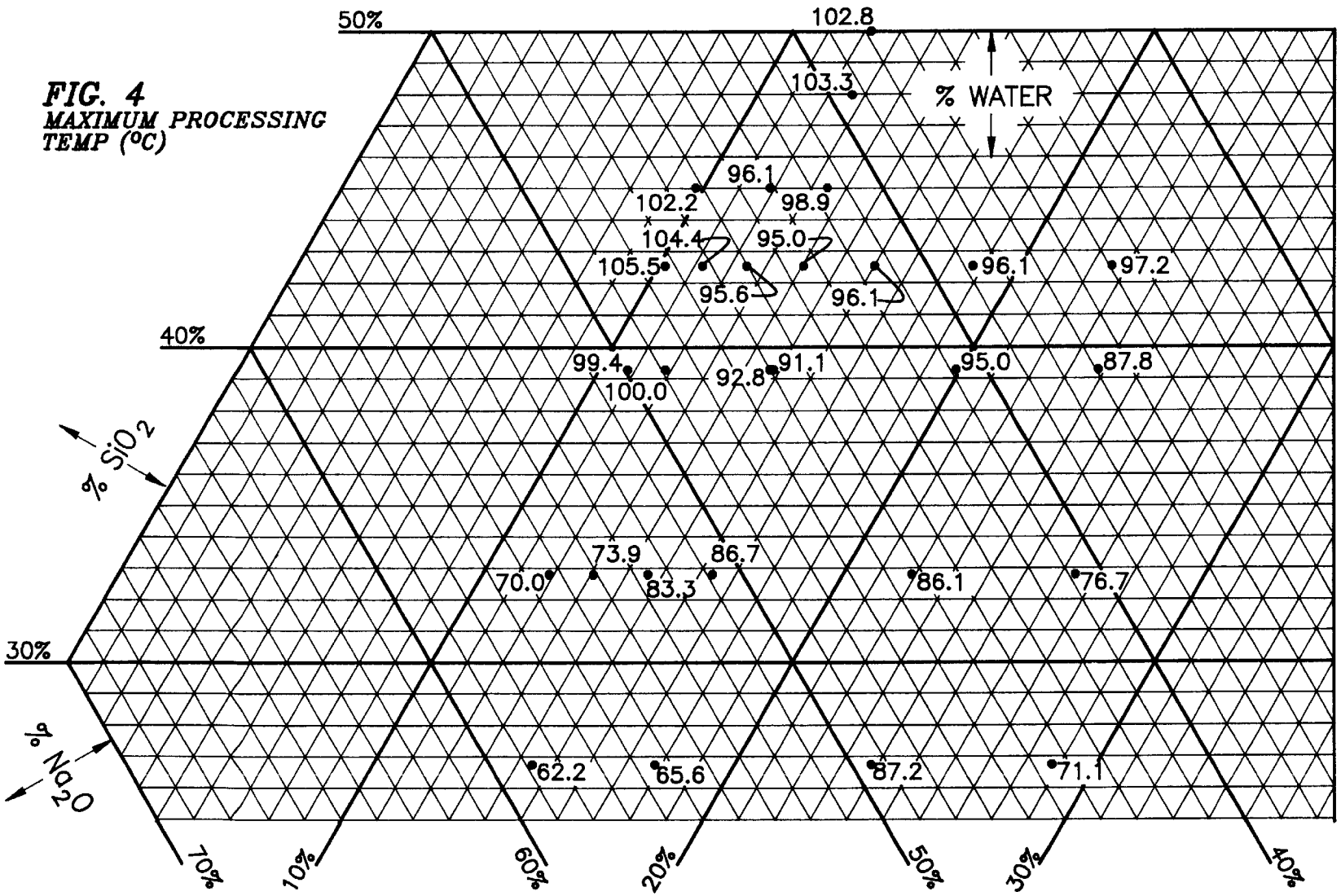
FIG. 4 is a portion of a ternary diagram depicting the maximum processing temperatures achieved during Experimental Trials 30–57 based upon the $H_2O$, $Na_2O$ and $SiO_2$ composition of the product.

A second obligatory consideration in selecting a reaction mixture formulation is solidification of the reaction product. Referring to Tables 9 and 10 and FIGS. 3 and 6, those reaction mixtures with an $Na_2O:SiO_2$ ratio of about 1.5:1 to about 4:1 and less than about 50 wt % water can form a reaction product which is solid under ambient conditions. In order to ensure that the reaction product remains solid during normal shipping, storage and use conditions, the reaction product should be able to remain solid up to at least 50° C. and preferably up to at least 65° C. In other words, the reaction product should have a melting point or a decomposition temperature of at least 50° C. and preferably at least 65° C.

An elective consideration in selecting a reaction mixture formulation is the rate at which the reaction mixture solidifies. Preferably, the reaction mixture solidifies within about 1 minute to about 1 hour, most preferably within about 2 to 30 minutes, after combination of the reactants. Reaction mixtures which solidify too quickly do not provide sufficient processing time and may result in a stratified reaction product and/or solidify prior to casting while those which solidify too slowly tend to retard the rate of production and/or permit separation of the individual components through settling unless a thickening agent is used.

Figure 6:
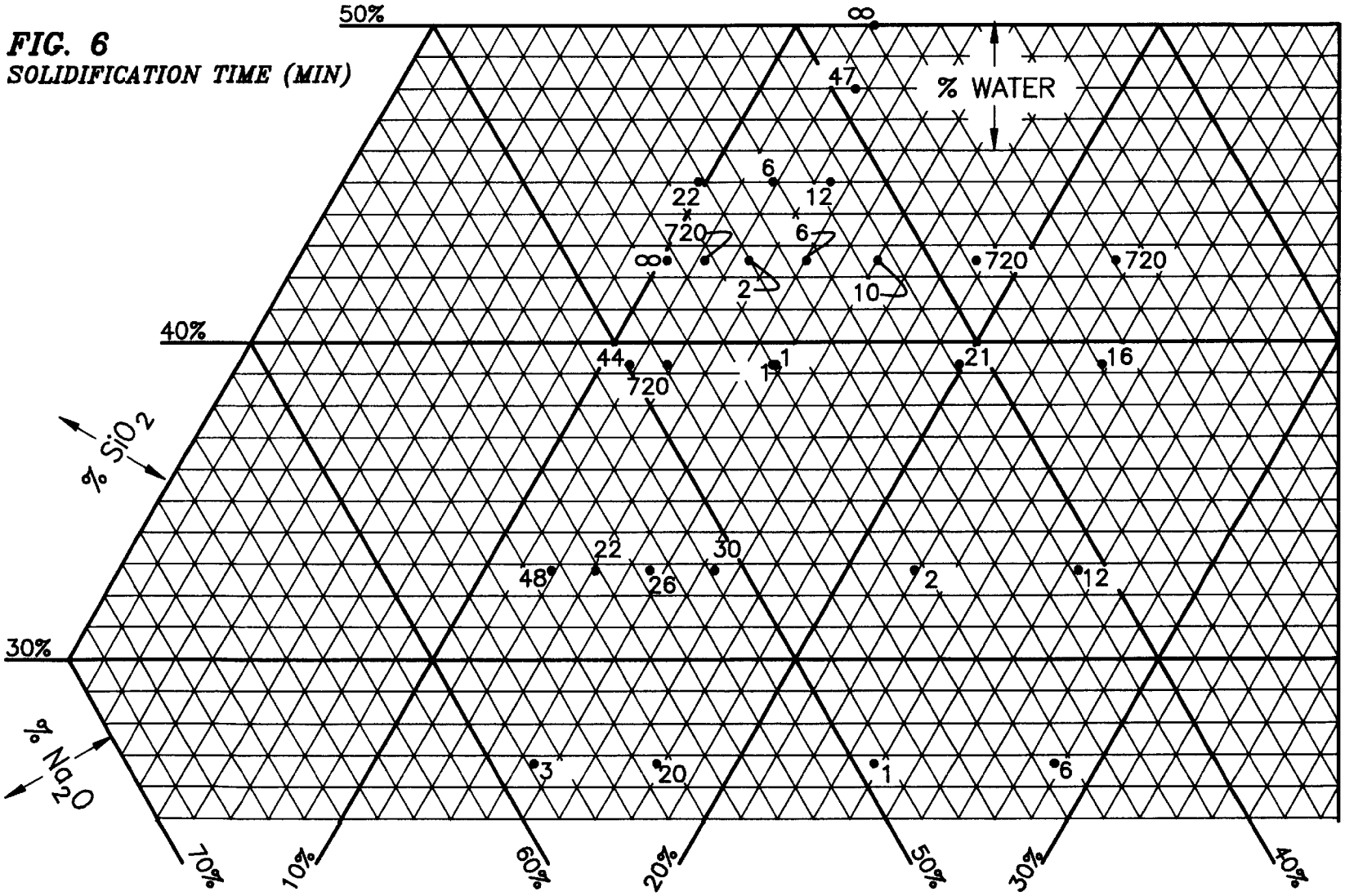
FIG. 6 is a portion of a ternary diagram depicting the solidification time of the products obtained in Experimental Trials 30–57 based upon the $H_2O$, $Na_2O$ and $SiO_2$ composition of the product.

Referring to Table 10 and FIG. 6, the rate at which the reaction mixture solidifies generally appears to increase (solidify faster) as the $Na_2O:SiO_2$ ratio increases and as the water content decreases. While not all the data correlates precisely with these stated general trends, the differences can be attributed to a certain extent to the subjective nature of the assessment as to when the reaction mixture solidified.

Figure 5:
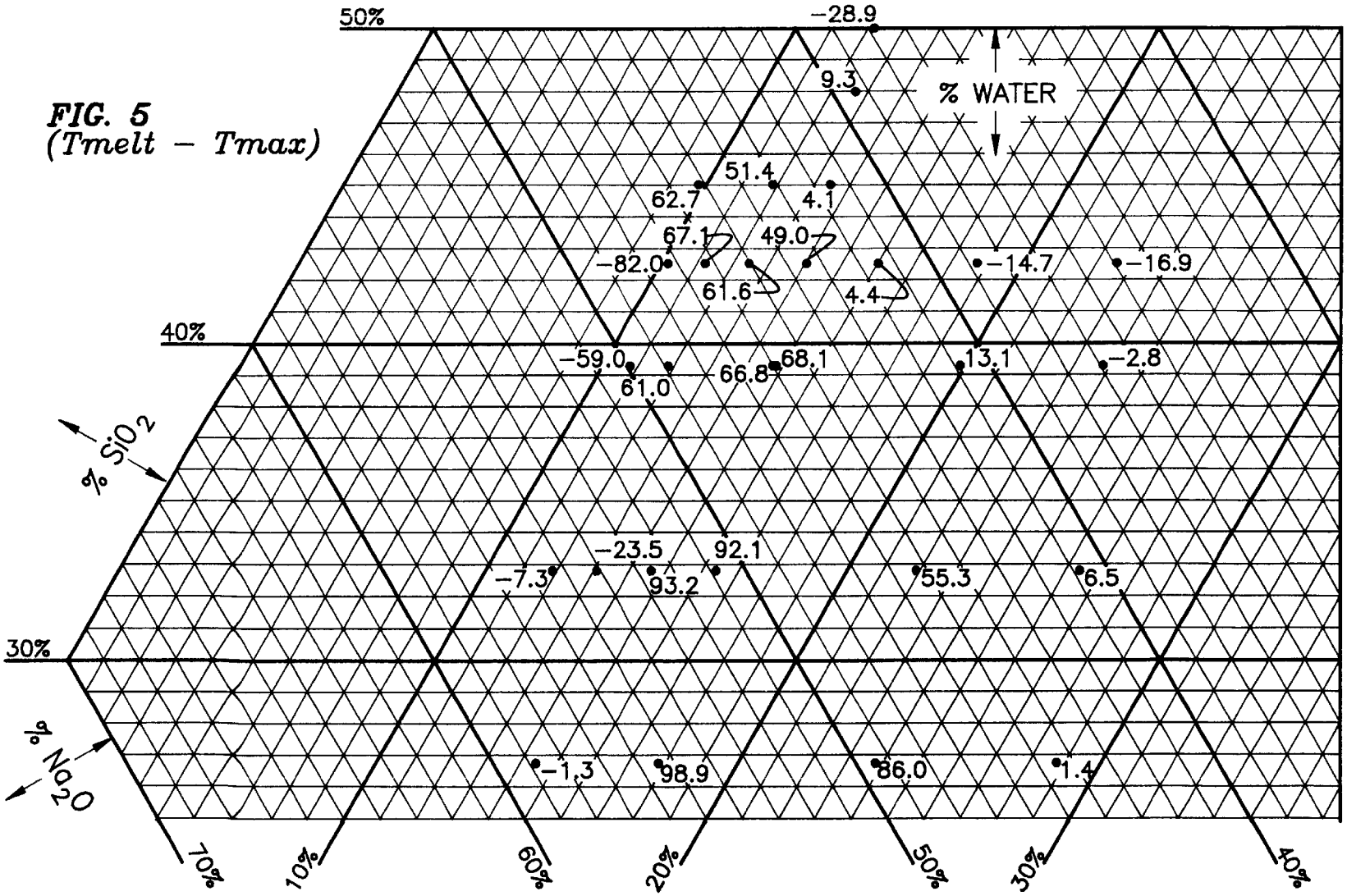
FIG. 5 is a portion of a ternary diagram depicting the $\Delta T$ of the products obtained in Experimental Trials 30–57 based upon the $H_2O$, $Na_2O$ and $SiO_2$ composition of the product.

Referring to Table 10 and a combination of FIGS. 5 and 6, the rate at which the reaction mixture solidifies also appears to be driven by the thermodynamic instability of the resultant reaction product as measured by the difference (ΔT) between the melt/decomposition temperature of the reaction product ($T_{melt}$) and the actual physical temperature of the liquid reaction product ($T_{actual}$). As a general principle, an increase in the thermodynamic instability of the reaction product (ΔT) causes an increase in the rate of solidification. In accordance with this general principle, the rate of solidification can be increased by producing a reaction product with a higher melting point or a decomposition temperature (increased $T_{melt}$) and/or reducing the actual temperature achieved by the reaction mixture during processing (decreased $T_{actual}$). In practice, the melting point or a decomposition temperature appears to affect the rate of solidification to a much greater extent than does the actual temperature. Without intending to limit the scope of the invention, the melting point or a decomposition temperature is believed to control the rate of solidification because variations in the actual temperature are believed to cause offsetting effects in the rate of solidification by changing the $\Delta T$ of the system and inversely changing the speed of molecular interactions within the reaction mixture/product.

A second elective consideration in selecting a reaction mixture formulation is the hardness of the completely solidified reaction product. Preferably, the reaction product is sufficiently hard that the cast product will not deform to any observable extent when subjected to the force of gravity for extended periods such as might occur during dispensing of the reaction product in a spray-type dispenser. Most preferably, the reaction product is sufficiently hard that the cast product may be removed from the mold and handled without support. Based upon the penetrometer data set forth in Table 10, the hardness of the completely solidified reaction product appears to increase with decreasing water content.

A third elective consideration in the selection of a reaction mixture formulation is the maximum temperature attained by the reaction mixture due to the exothermic reaction between the silicate, the hydroxide and the water. An exothermic reaction which raises the actual temperature above the melt/decomposition temperature of the reaction mixture and/or reaction product eliminates the benefits derived from producing the reaction product without attaining melt/decomposition temperatures. Accordingly, the reaction mixture should be formulated to prevent an exothermic reaction which would cause the reaction mixture or the reaction product to melt. In other words, the melt/decomposition temperature of the reaction product ($T_{melt}$) should be greater than the maximum processing temperature attained by the reaction mixture and/or reaction product ($T_{max}$) and is preferably greater by at least 10° C.

If desired, the maximum processing temperature attained by the reaction mixture and/or reaction product can be decreased by prereacting a portion of the reactants, cooling the prereaction product, and then employing the cooled prereaction product in the reaction mixture. Experimental Trials 18,23,25,26,29 and 30 demonstrate the use of this prereaction step by neutralizing Bayhibit PB AM® with sodium hydroxide prior to introduction of the Bayhibit PB AM® into the reaction mixture. The extent to which reactants can be prereacted is limited by the requirement that the prereaction product must be processable. The prereaction product must be capable of being dispersed throughout the final reaction mixture so as to be substantially uniformly intermixed within the resultant solid reaction product.

A final elective consideration in the selection of a reaction mixture formulation is the solubility of the completely solidified reaction product. The reaction product must be dissolved or otherwise dispersed in water to be effective. Therefore, the formulation and means of dispensing the reaction product must be capable of delivering the reaction product into a water supply at a reasonable rate. The reaction product could be dissolved prior to use to assure a ready supply of cleaning solution. However, such a dispensing system eliminates many of the advantages offered by solid cast compositions. To satisfactorily perform in most institutional and commercial dispensers of cleansing solutions, the reaction product should be capable of readily dissolving directly from the solid form at a rate of about 10 to 50 grams of active components (silicate, hydroxide and additional operative cleaning components) per minute, most preferably about 15 to 30 grams of active components per minute. The rate of dissolution depends upon several variables, including (i) formulation of the reaction product, (ii) method of dispensing the reaction product, (iii) shape of the solidified reaction product, (iv) amount of surface area contact between reaction product and solvent, (v) solvent temperature, (vi) solvent flow rate, and (vii) solvent pressure. These variables may be independently adjusted to obtain the desired dispensing rate.

Because the reaction product remains below the melt/decomposition temperature and solidifies so quickly, it is believed that the silicate contained in the solidified reaction product is present in various hydrated forms depending upon the final sodium oxide:silicon dioxide ratio in the reaction product, the presence of other reactants and the availability of water during processing.

Operative cleaning components may be added to the reaction mixture formulation as desired in order to enhance a particular cleaning property or characteristic so long as the component(s) does not significantly interfere with solidification of the reaction mixture formula. A particularly effective operative cleaning component useful in the silicate-based alkaline detergent composition of this invention for holding or suspending divalent and trivalent hardness ions in the wash water and thereby reducing spotting, filming and liming of the washed surface is a threshold system including a combination of a polyacrylate and an organic phosphonate. As demonstrated in Tables 13 through 27, this threshold system cooperates in a synergistic fashion with the silicate-based detergent composition to effectively suspend both calcium and magnesium hardness ions.

The preferred polyacrylate has a molecular weight of about 2,000 to 7,000 such as Acrysol LMW-45ND®, a granular polyacrylic acid having an average molecular weight of about 4,500 available from the Rohm and Haas Company. Polyacrylates with a molecular weight of less than about 2,000 and more than about 7,000 are significantly less effective as evidenced by Tables 15, 17, 19, 20, 21, and 23.

Preferred organic phosphonates include Dequest 2010®, a 1-Hydroxyethylidene-1,1-diphosphonic acid, available from Monsanto, and Bayhibit PB AM®, a 2-phosphonobutane-1,2,4-tricarboxylic acid, available from the Mobay Corporation.

A detailed discussion of suitable phosphonates is provided in commonly owned U.S. Pat. No. 4,846,993 issued to Lentsch et al. which is hereby incorporated by reference.

A ratio of about 2 to 6 parts polyacrylate to 1 part phosphonate is preferred at a loading of about 0.2 to 2 parts threshold system (polyacrylate and phosphonate) to 1 part silicate.

The alkali metal silicate, alkali metal hydroxide and water are preferably combined by adding the alkali metal hydroxide to an aqueous solution of the alkali metal silicate. The alkali metal silicate may be added to an aqueous solution of the alkali metal hydroxide but is less preferred because solid alkali metal silicates have a low dissolution rate in alkali metal hydroxide solutions.

The reaction mixture may be blended using both batch and continuous mixers with continuous mixers preferred for convenience. Substantially any standard mixer can be employed without difficulty.

The reaction mixture should be agitated until the components are uniformly dispersed throughout the mixture and then quickly cast in order to minimize solidification within the mixer. Self cleaning, continuous mixers which can provide effective mixing with residence times of less than about 20 seconds are preferred in order to reduce solidification of product within the mixer.

The reaction mixture may be cast into a temporary mold from which it is subsequently transferred for packaging or may be cast directly into the packaging receptacle. Preferably, the reaction mixture is cast directly into the packaging container in order to eliminate the transfer step.

The packaging container may be made from any material capable of housing the highly caustic reaction mixture and reaction product including such materials as glass, steel, polyethylene, polypropylene, cardboard and cardboard composites. When the reaction mixture is cast directly into the container, the container must be capable of withstanding the temperatures encountered during the process due to the exothermic reaction between the alkali metal silicate, alkali metal hydroxide and water (about 40° to about 105° C.). The container may be rigid or flexible. Because of its low cost and ability to structurally withstand chemical contact with the alkaline composition and processing temperatures of up to about 80° C., the container is preferably a rigid or flexible container constructed from a polyolefin such as polyethylene.

Since the reaction product solidifies substantially simultaneously throughout the entire cross section without the need to cool the product, the product may be cast into any desired size and shape.

The reaction product is preferably dispensed from a spray-type dispenser such as those disclosed in U.S. Pat. Nos. 4,826,661, 4,690,305, 4,687,121, and 4,426,362. Briefly, a spray-type dispenser functions by impinging a water spray upon an exposed surface(s) of the solid block of material so as to dissolve a portion of the material and then immediately directing the solution out of the dispenser to a reservoir or directly to a point of use. Table 8 provides an indication of the solubility of two reaction products in two different spray-type dispensers.

Experimental Procedure

(Trials 1–29)

The reactants identified in Table 4 were placed into a polypropylene container equipped with a laboratory agitator in accordance with the sequence set forth in Table 5 to form a reaction mixture. The reaction mixture was agitated as set forth in Table 6 and then allowed to solidify at room temperature. The temperature attained by the reaction mixture due to an exothermic reaction between the reactants is also provided in Table 6. Specifics as to the rate of solidification and the physical characteristics of the solidified product are provided in Table 7.

Testing Procedures

Penetrometer

The product was tested with a Precision Penetrometer, manufactured by GCA Precision Scientific, using a #73520 needle, also manufactured by GCA Precision Scientific. Time of testing noted in Table 7 represents the time between completion of reaction product agitation and commencement of the testing.

Step 1—Raise the penetrometer needle and scale connecting rod to their maximum height.

Step 2—Position the product directly underneath the penetrometer needle.

Step 3—Adjust the height of the entire needle-retention block to position the point of the needle immediately above the surface of the product.

Step 4—Start the machine and permit the penetrometer needle to. penetrate into the test specimen for 5 seconds, plus or minus 0.2 seconds.

Step 5—Record the distance traveled by the penetrometer needle to the nearest millimeter.

Step 6—Repeat the procedure at a different position on the surface of the product to obtain 3 measurements.

Step 7—Average the 3 measurements to obtain the penetrometer hardness factor of the product.

Differential Scanning Calorimeter

The product was tested with a Perkin/Elmer DSC-7 Differential Scanning Calorimeter equipped with a Perkin/Elmer 3700 Data Station, a Perkin/Elmer TAC 7/3 Instrument Controller and a Perkin/Elmer Graphics Plotter 2. The tests were conducted in accordance with the operating instructions provided with the equipment employing the "parameters" and "conditions" set forth below.

| Parameters | | Conditions | |
|---|---|---|---|
| T Final: | 200.0° C. | End Conditions: | L |
| T Start: | 20.0° C. | Load Temp: | 20.0° C. |
| T Min: | 20.0° C. | Go to Temp Rate: | 200.0 |
| Scanning Rate: | 10.0 (° C./min) | Valve 1 Time: | 0.0 |
| Y Range: | 10.0 | Valve 2: | 0.0 |
| Sample Wt: | (3–7 mg) | Delay Time: | 0.0 |
| Baseline Status: | N | Y Initial: | 50 |
| Multitasking: | N | | |

The test samples (3–7 mg) were sealed in a stainless steel capsule using a Perkin/Elmer quick Press equipped with a Spacer Die. The reference capsule employed in the procedure was a stainless steel capsule which had been sealed empty.

| | Legend |
|---|---|
| Acrysol LMW-45 | Polyacrylic acid having an average molecular weight of 4,500 in a 50% aqueous solution available from the Rohm and Haas Company. |
| Acrysol LMW-45ND | Granular polyacrylic acid having an average molecular weight of 4,500 available from the Rohm and Haas Company. |
| Acrysol LMW-10N | An aqueous solution of average molecular weight of 1,000 available from Rohm and Haas Company. (Abbreviated LMW 10N) |
| Acrysol LMW-100N | An aqueous solution of polyacrylic acid having an average molecular weight of 10,000 available from Rohm and Haas Company. (Abbreviated LMW-100N) |
| Alcosperse 149 ™ | A polyacrylate having an average molecular weight of about 2,000 available from Alco Chemical Company. (Abbreviated Alco 149) |
| Alcosperse 175 ™ | A ring opened copolymer of acrylic acid and maleic anhydride having an average molecular weight of about 20,000 available from Alco Chemical Company. (Abbreviated Alco 175) |
| Belsperse 161 ™ | A 50% aqueous solution of a polyacrylate containing phosphono groups in the backbone which has a molecular weight of about 4,000 available from Ciba-Geigy. (Abbreviated Bels 161) |

-continued

| | Legend |
|---|---|
| Goodright 7058D ™ | Powdered salt of granular polyacrylic acid having an average molecular weight of about 6,000 available from B. F. Goodrich. (Abbreviated Gdright 7058D) |
| Cyanamer P-35 ™ | A polyacrylamide available from American Cyanamide of Wayne, NJ. (Abbreviated CyP35) |
| PAA[1] | A homopolyrner of acrylic acid having an average molecular weight of about 5,000. |
| PAA[2] | A copolymer of acrylic acid and itaconic acid having an average molecular weight of about 8,000. |
| PAA[3] | A homopolymer of acrylic acid having an average molecular weight of about 10,000. |
| DCDPP | 1,5-dicarboxy 3,3-diphosphono pentane having a solids content of about 90%. |
| Bayhibit PB AM ® | Aqueous solution of 2-phosphonobutane-1,2,4-tricarboxylic acid having a solids content of 45–50% available from the Mobay Corporation. (Abbreviated Byhbt). |
| Neutralized Bayhibit PB AM ® | Bayhibit PB AM ® which has been neutralized with NaOH beads at a weight ratio of 1.35:1 Bayhibit to NaOH. |
| Dequest 2016 ® | Aqueous solution of 1-hydroxyethylidene bis phosphonic acid tetra sodium salt available from Monsanto. |
| Dequest 2010 ® | 60% active aqueous solution of 1-hydroxy-ethylidene-1,1-Diphosphonic acid available from Monsanto. |
| Neutralized Dequest 2010 ® | Dequest 2010 ® which has been (i) neutralized with NaOH beads at a weight ratio of 2.14:1 Dequest to NaOH, (ii) screen ground, and (iii) vacuum dried. |
| Dowfax 3B2 ® | Aqueous solution of Decyl (sulfophenoxy)-benzene-sulfonic acid disodium salt and oxybis (decylbenzene sulfonic acid) disodium salt having a maximum active content of 47% available from Dow Chemical Company. |
| Chlorine Source | Granular dichloroisocyanurate encapsulated with an inner coating of sodium sulfate and an outer coating of sodium octyl sulfonate manufactured by Ecolab, Inc. (See specification for manufacturing process.) |
| EO/PO Surfactant 1 | Propylene oxide terminated ethylene oxide/propylene oxide block copolymer having a 1% solution cloud point at 85–90° F.. |
| EO/PO Surfactant 2 | Ethylene oxide/propylene oxide block copolymer having a 1% solution cloud point at 93–100° F.. |
| EO/PO Surfactant 3 | Propylene oxide modified nonionic EO/PO block surfactant having a 10% solution cloud point at 107–110° F.. |
| Bz-EOx-R | Benzyl ether of a polyethoxylated linear alcohol having a 1% solution cloud point at 60–64° F. made in accordance with the procedure set forth in U.S. Pat. No. 3,444,242. |
| LAS Flake ® | Flaked alkyl benzene sulfonate available from Stepen Company. |
| Neodol 25-7 ® | Mixture of $C_{12-15}$ alcohol ethoxylates available from Shell Chemical Company. |
| NPE 9.5 | Polyethylene glycol ether of nonyl phenol having an average of 9.5 moles ethylene oxide per mole of nonyl phenol. |
| Pluronic RA40 ® | Alkoxylated fatty alcohol from BASF Wyandotte Corporation - Chemicals Division |
| RU Silicate ® | Sodium silicate solution having an $Na_2O:SiO_2$ weight ratio of about 0.4:1.0 and a solids content of 47.05% available from the PQ Corporation. |
| Triton CF-21 ® | An alkylaryl polyalkoxylate available from Rohm and Haas Corporation. |
| Versene 220 ® | Powdered EDTA available from Dow Chemical Company. |
| NTA | Nitrilotriacetic acid monohydrate available from Monsanto. |
| Powdered Tripoly-phospate | Tripolyphosphate having a particle size which provides at least 95% passage through a 60 mesh screen, and at least 90% passage through a 100 mesh screen. |

-continued

| | Legend |
|---|---|
| Granular Tripoly-phosphate | Tripolyphosphate having a particle size which provides at least 99.5% passage through a 12 mesh screen, at least 88% passage through a 20 mesh screen, and less than 5% passage through a 200 mesh screen. |
| Large Granular Tri-polyphosphate | Tripolyphosphate having a particle size which provides at least 98% passage through an 8 mesh screen, less than 10% passage through a 30 mesh screen, and less than 5% passage through a 100 mesh screen. |

TABLE 4

Composition of Trials (grams)

| | Trl #1 | Trl #2 | Trl #3 | Trl #4 | Trl #5 | Trl #6 |
|---|---|---|---|---|---|---|
| RU Silicate | 32.8 | 32.8 | 32.8 | 32.8 | 32.8 | 32.8 |
| Sodium Metasilicate | 10.5 | 10.5. | 10.5 | 10.5 | 10.5 | 10.5 |
| Sodium Hydroxide Bead | 26.2 | 26.2 | 26.2 | 26.2 | 26. 2 | 26. 2 |
| Water | | | | | | |
| SURFACTANT/BUILDERS | | | | | | |
| Acrysol LMW | | | | | | |
| Acrysol LMW-45ND ® | | | | | | |
| Acrysol LMW-100N ® | | | | | | |
| Bayhibit PB AM ® | | | | | | |
| Neut | | | | | | |
| Dequest 2010 ® | | | | | | |
| Dequest 2016 ® | | | | | | |
| Neutralized Dequest ® | 4.0 | 4.0 | 4.0 | 4.0 | 4.0 | 4.0 |
| Dowfax 3B2 ® | | | | | | |
| EO/PO Surfactant 1 | 10.0 | | | | | |
| EO/PO Surfactant 2 | | | | | | |
| EO/PO Surfactant 3 | | | | | | |
| Bz-EOx-R | | 10.0 | | | | |
| LAS Flake ® | | | 10.0 | | | |
| Goodrite 7058ND ™ | 12.7 | 12.7 | 12.7 | 12.7 | 12.7 | 12.7 |
| Neodol 25-7 ® | | | | | 10.0 | |
| NPE 9.5 ® | | | | | | 10.0 |
| Pluronic RA40 ® | | | | 10.0 | | |
| Triton CF-21 ® | | | | | | |
| Versene 220 ® | | | | | | |
| NTA | | | | | | |
| Powered/TPP | | | | | | |
| Sm Granular/TPP | | | | | | |
| Lg Granular/TPP | | | | | | |
| BLEACH | | | | | | |
| Ecolab Chlorine | | | | | | |
| DILUENT | | | | | | |
| Sodium Chloride | | | | | | |

| | Trl #7 | Trl #8 | Trl #9 | Trl #10 | Trl #11 | Trl #12 |
|---|---|---|---|---|---|---|
| RU Silicate | 1389.2 | 521.3 | 481.3 | 1312.0 | 1392.6 | 34.4 |
| Sodium Metasilicate | 445.3 | 167.2 | 154.4 | 420.7 | 533.0 | 11.0 |
| Sodium Hydroxide Bead | 1269.7 | 476.9 | 440.3 | 1200.2 | 1274.0 | 31.5 |
| Water | | | | | | |
| SURFACTANT/BUILDERS | | | | | | |
| Acrysol LMW | | | 218.0 | | | |
| Acrysol LMW-45ND ® | | 144.0 | | | | 9.5 |
| Acrysol LMW-100N ® | | | | | | |
| Bayhibit PB AM ® | | | | | | |

TABLE 4-continued

| Composition of Trials (grams) | | | | | | |
|---|---|---|---|---|---|---|
| Neut | | | | | | |
| Dequest 2010 ® | | | 54.4 | | | |
| Dequest 2016 ® | | | | | | |
| Neutralized Dequest ® | 103.5 | 39.0 | | 138.2 | | 2.6 |
| Dowfax 3B2 ® | | | | | | |
| EO/PO Surfactant 1 | 37.8 | 13.6 | 13.6 | 48.6 | 37.3 | 0.9 |
| EO/PO Surfactant 2 | | | | | | |
| EO/PO Surfactant 3 | | | | | | |
| Bz-EOx-R | | | | | | |
| LAS Flake ® | | | | | | |
| Goodrite 7058ND ™ | 386.4 | | | 512.3 | 395.0 | |
| Neodol 25-7 ® | | | | | | |
| NPE 9.5 | | | | | | |
| Pluronic RA40 ® | | | | | | |
| Triton CF-21 ® | | | | | | |
| Versene 220 ® | | | | | | |
| NTA | | | | | | |
| Powered/TPP | | | | | | |
| Sm Granular/TPP | | | | | | |
| Lg Granular/TPP | | | | | | |
| BLEACH | | | | | | |
| Ecolab Chlorine | | | | | | 10.0 |
| DILUENT | | | | | | |
| Sodium Chloride | | | | | | |

| | Trl #13 | Trl #14 | Trl #15 | Trl #16 | Trl #17 | Trl #18 |
|---|---|---|---|---|---|---|
| RU Silicate | 32.2 | 457.3 | 487.0 | 487.0 | 492.0 | 168.6 |
| Sodium Metasilicate | 10.3 | 146.7 | 156.2 | 156.2 | 157.8 | 54.1 |
| Sodium Hydroxide Bead | 29.4 | 418.4 | 445.5 | 445.5 | 450.0 | 154.2 |
| Water | | | | | | |
| SURFACTANT/BUILDERS | | | | | | |
| Acrysol LMW | | | | | | |
| Acrysol LMW-45ND ® | 12.7 | 192.0 | 190.2 | 190.2 | 192.1 | |
| Acrysol LMW-100N ® | | | | 13.7 | | |
| Bayhibit PB AM ® | | | | | | 46.2 |
| Neut | | | | | | |
| Dequest 2010 ® | | | | | | |
| Dequest 2016 ® | | 129.5 | | | | |
| Neutralized Dequest ® | 3.4 | | 51.4 | 51.4 | 51.9 | |
| Dowfax 3B2 ® | | | 13.7 | | | |
| EO/PO Surfactant 1 | 1.2 | 18.1 | 18.0 | 18.0 | 18.2 | 6.1 |
| EO/PO Surfactant 2 | | | | | | |
| EO/PO Surfactant 3 | | | | | | |
| Bz-EOx-R | | | | | | |
| LAS Flake ® | | | | | | |
| Goodrite 7058ND ™ | | | | | | 70.5 |
| Neodol 25-7 ® | | | | | | |
| NPE 9.5 | | | | | | |
| Pluronic RA40 ® | | | | | | |
| Triton CF-21 ® | | | | | | |
| Versene 220 ® | | | | | | |
| NTA | | | | | | |
| Powered/TPP | | | | | | |
| Sm Granular/TPP | | | | | | |
| Lg Granular/TPP | | | | | | |
| BLEACH | | | | | | |
| Ecolab Chlorine | 10.7 | | | | | |
| DILUENT | | | | | | |
| Sodium Chloride | | | | | | |

| | Trl #19 | Trl #20 | Trl #21 | Trl #22 | Trl #23 | Trl #24 |
|---|---|---|---|---|---|---|
| RU Silicate | 399.4 | 399.4 | 389.2 | 723.3 | 818.4 | 818.4 |
| Sodium Metasilicate | 128.1 | 128.1 | 124.8 | 234.8 | 262.4 | 262.4 |
| Sodium Hydroxide Bead | 365.4 | 365.4 | 365.0 | 670.0 | 748.7 | 748.7 |

TABLE 4-continued

| Composition of Trials (grams) | | | | | | |
|---|---|---|---|---|---|---|
| Water | | | | | | |
| SURFACTANT/BUILDERS | | | | | | |
| Acrysol LMW | | | | | | |
| Acrysol LMW-45ND ® | 45.0 | 45.0 | 68.0 | 82.4 | 352.3 | 352.1 |
| Acrysol LMW-100N ® | | | | | | |
| Bayhibit PB AM ® | | | | | 231.9 | |
| Neut | | | | | | |
| Dequest 2010 ® | | | | | | |
| Dequest 2016 ® | | | | | | |
| Neutralized Dequest ® | | | | | | |
| Dowfax 3B2 ® | | | | | | |
| EO/PO Surfactant 1 | 7.2 | 7.2 | 7.2 | 13.3 | | |
| EO/PO Surfactant 2 | | | | | 27.6 | 27.6 |
| EO/PO Surfactant 3 | | | | | 55.7 | 55.7 |
| Bz-EOx-R | | | | | | |
| LAS Flake ® | | | | | | |
| Goodrite 7058ND ™ | | | | | | |
| Neodol 25-7 ® | | | | | | |
| NPE 9.5 | | | | | | |
| Pluronic RA40 ® | | | | | | |
| Triton CF-21 ® | | | | | | |
| Versene 220 ® | | | | | | |
| NTA | | | | | | |
| Powered/TPP | | 416.8 | | | | |
| Sm Granular/TPP | 416.8 | | | | | |
| Lg Granular/TPP | | | 416.8 | | | |
| BLEACH | | | | | | |
| Ecolab Chlorine | | | | | | |
| DILUENT | | | | | | |
| Sodium Chloride | | | | | | 231.9 |

| | Trl #25 | Trl #26 | Trl #27 | Trl #28 | Trl #29 |
|---|---|---|---|---|---|
| RU Silicate | 818.4 | 830.7 | 733.1 | 733.1 | 374.0 |
| Sodium Metasilicate | 262.4 | 266.4 | | | |
| Sodium Hydroxide Bead | 748.7 | 759.9 | 844.3 | 844.3 | 1258.6 |
| Water | | | 145.4 | 145.4 | 224.4 |
| SURFACTANT/BUILDERS | | | | | |
| Acrysol LMW | | | | | |
| Acrysol LMW-45ND ® | | 352.0 | | | 352.0 |
| Acrysol LMW-100N ® | | | | | |
| Bayhibit PB AM ® Neut | 231.9 | 232.3 | | | 232.3 |
| Dequest 2010 ® | | | | | |
| Dequest 2016 ® | | | | | |
| Neutralized Dequest ® | | | | | |
| Dowfax 3B2 ® | | | | | |
| EO/PO Surfactant 1 | | | 25.1 | 25.1 | 55.7 |
| EO/PO Surfactant 2 | 27.6 | | | | |
| EO/PO Surfactant 3 | 55.7 | | | | |
| Bz-EOx-R | | | | | |
| LAS Flake ® | | | | | |
| Goodrite 7058ND ™ | | | | | |
| Neodol 25-7 ® | | | | | |
| NPE 9.5 | | | | | |
| Pluronic RA40 ® | | | | | |
| Triton CF-21 ® | | 55.7 | | | |
| Versene 220 ® | | | 749.2 | | |
| NTA | | | | 749.2 | |
| Powered/TPP | | | | | |
| Sm Granular/TPP | | | | | |
| Lg Granular/TPP | | | | | |
| BLEACH | | | | | |
| Ecolab Chlorine | | | | | |
| DILUENT | | | | | |
| Sodium Chloride | 352.3 | | | | |

TABLE 5

Order of Addition

| | Trl #1 | Trl #2 | Trl #3 | Trl #4 | Trl #5 | Trl #6 |
|---|---|---|---|---|---|---|
| RU Silicate | 1 | 1 | 1 | 1 | 1 | 1 |
| Sodium Metasilicate | 6 | 6 | 6 | 6 | 6 | 6 |
| Sodium Hydroxide Bead | 3 | 3 | 3 | 3 | 3 | 3 |
| Water | | | | | | |
| SURFACTANT/BUILDERS | | | | | | |
| Acrysol LMW | | | | | | |
| Acrysol LMW-45ND ® | | | | | | |
| Acrysol LMW-100N ® | | | | | | |
| Bayhibit PB AM ® Neut | | | | | | |
| Dequest 2010 ® | | | | | | |
| Dequest 2016 ® | | | | | | |
| Neutralized Dequest ® | 4 | 4 | 4 | 4 | 4 | 4 |
| Dowfax 3B2 ® | | | | | | |
| EO/PO Surfactant 1 | 2 | | | | | |
| EO/PO Surfactant 2 | | | | | | |
| EO/PO Surfactant 3 | | | | | | |
| Bz-EOx-R | | 2 | | | | |
| LAS Flake ® | | | 2 | | | |
| Goodrite 7058ND ™ | 5 | 5 | 5 | 5 | 5 | 5 |
| Neodol 25-7 ® | | | | | 2 | |
| NPE 9.5 | | | | | | 2 |
| Pluronic RA40 ® | | | | | | |
| Triton CF-21 ® | | | | | | |
| Versene 220 ® | | | | | | |
| NTA | | | | | | |
| Powered/TPP | | | | | | |
| Sm Granular/TPP | | | | | | |
| Lg Granular/TPP | | | | | | |
| BLEACH | | | | | | |
| Ecolab Chlorine | | | | | | |
| DILUENT | | | | | | |
| Sodium Chloride | | | | | | |

| | Trl #7 | Trl #8 | Trl #9 | Trl #10 | Trl #11 | Trl #12 |
|---|---|---|---|---|---|---|
| RU Silicate | 1 | 1 | 1 | 1 | 1 | 1 |
| Sodium Metasilicate | 5 | 5 | 6 | 6 | 4 | 4 |
| Sodium Hydroxide Bead | 2 | 2 | 2 | 2 | 2 | 2 |
| Water | | | | | | |
| SURFACTANT/BUILDERS | | | | | | |
| Acrysol LMW | | | 4 | | | |
| Acrysol LMW-45ND ® | | 6 | | | | 4 |
| Acrysol LMW-100N ® | | | | | | |
| Bayhibit PB AM ® Neut | | | | | | |
| Dequest 2010 ® | | | 5 | | | |
| Dequest 2016 ® | | | | | | |
| Neutralized Dequest ® | 4 | 4 | | 4 | | 4 |
| Dowfax 3B2 ® | | | | | | |
| EO/PO Surfactant 1 | 3 | 3 | 3 | 3 | 3 | 3 |
| EO/PO Surfactant 2 | | | | | | |
| EO/PO Surfactant 3 | | | | | | |
| Bz-EOx-R | | | | | | |
| LAS Flake ® | | | | | | |
| Goodrite 7058ND ™ | 6 | | | 5 | 4 | |
| Neodol 25-7 ® | | | | | | |
| NPE 9.5 | | | | | | |
| Pluronic RA40 ® | | | | | | |
| Triton CF-21 ® | | | | | | |
| Versene 220 ® | | | | | | |
| NTA | | | | | | |
| Powered/TPP | | | | | | |
| Sm Granular/TPP | | | | | | |
| Lg Granular/TPP | | | | | | |
| BLEACH | | | | | | |
| Ecolab Chlorine | | | | | | 5 |

TABLE 5-continued

Order of Addition

| | Trl #13 | Trl #14 | Trl #15 | Trl #16 | Trl #17 | Trl #18 |
|---|---|---|---|---|---|---|
| DILUENT | | | | | | |
| Sodium Chloride | | | | | | |
| RU Silicate | 1 | 1 | 1 | 1 | 1 | 1 |
| Sodium Metasilicate | 4 | 5 | 5 | 5 | 4 | 4 |
| Sodium Hydroxide Bead | 3 | 2 | 2 | 2 | 2 | 4 |
| Water | | | | | | |
| SURFACTANT/BUILDERS | | | | | | |
| Acrysol LMW | | | | | | |
| Acrysol LMW-45ND ® | 4 | 6 | 5 | 5 | 4 | |
| Acrysol LMW-100N ® | | | | 4 | | |
| Bayhibit PB AM ® Neut | | | | | | 3 |
| Dequest 2010 ® | | | | | | |
| Dequest 2016 ® | | 4 | | | | |
| Neutralized Dequest ® | 4 | | 5 | 5 | 4 | 4 |
| Dowfax 3B2 ® | | | 4 | | | |
| EO/PO Surfactant 1 | 2 | 3 | 3 | 3 | 3 | 2 |
| EO/PO Surfactant 2 | | | | | | |
| EO/PO Surfactant 3 | | | | | | |
| Bz-EOx-R | | | | | | |
| LAS Flake ® | | | | | | |
| Goodrite 7058ND ™ | | | | | | 4 |
| Neodol 25-7 ® | | | | | | |
| NPE 9.5 | | | | | | |
| Pluronic RA40 ® | | | | | | |
| Triton CF-21 ® | | | | | | |
| Versene 220 ® | | | | | | |
| NTA | | | | | | |
| Powered/TPP | | | | | | |
| Sm Granular/TPP | | | | | | |
| Lg Granular/TPP | | | | | | |
| BLEACH | | | | | | |
| Ecolab Chlorine | 5 | | | | | |
| DILUENT | | | | | | |
| Sodium Chloride | | | | | | |

| | Trl #19 | Trl #20 | Trl #21 | Trl #22 | Trl #23 | Trl #24 |
|---|---|---|---|---|---|---|
| RU Silicate | 1 | 1 | 1 | 1 | 1 | 1 |
| Sodium Metasilicate | 3 | 3 | 4 | 3 | 4 | 3 |
| Sodium Hydroxide Bead2 | 2 | 2 | 2 | 2 | 2 | 2 |
| Water | | | | | | |
| SURFACTANT/BUILDERS | | | | | | |
| Acrysol LMW | | | | | | |
| Acrysol LMW-45ND ® | 3 | 3 | 3 | 3 | 4 | 3 |
| Acrysol LMW-100N ® | | | | | | |
| Bayhibit PB AM ® Neut | | | | | 3 | |
| Dequest 2010 ® | | | | | | |
| Dequest 2016 ® | | | | | | |
| Neutralized Dequest ® | | | | | | |
| Dowfax 3B2 ® | | | | | | |
| EO/PO Surfactant 1 | 1 | 1 | 1 | 1 | | |
| EO/PO Surfactant 2 | | | | | 1 | 1 |
| EO/PO Surfactant 3 | | | | | 1 | 1 |
| Bz-EOx-R | | | | | | |
| LAS Flake ® | | | | | | |
| Goodrite 7058ND ™ | | | | | | |
| Neodol 25-7 ® | | | | | | |
| NPE 9.5 | | | | | | |
| Pluronic RA40 ® | | | | | | |
| Triton CF-21 ® | | | | | | |
| Versene 220 ® | | | | | | |
| NTA | | | | | | |
| Powered/TPP | | 3 | | 3 | | |
| Sm Granular/TPP | 3 | | | | | |
| Lg Granular/TPP | | | 4 | | | |

TABLE 5-continued

| Order of Addition | | | | | |
|---|---|---|---|---|---|
| BLEACH | | | | | |
| Ecolab Chlorine | | | | | |
| DILUENT | | | | | |
| Sodium Chloride | | | | | 3 |
| | Trl #25 | Trl #26 | Trl #27 | Trl #28 | Trl #29 |
| RU Silicate | 1 | 1 | 1 | 1 | 1 |
| Sodium Metasilicate | 4 | 4 | | | |
| Sodium Hydroxide Bead | 2 | 2 | 3 | 3 | 3 |
| Water | | | 2 | 2 | 2 |
| SURFACTANT/BUILDERS | | | | | |
| Acrysol LMW | | | | | |
| Acrysol LMW-45ND ® | | 4 | | | 5 |
| Acrysol LMW-100N ® | 4 | | | | |
| Bayhibit PB AM ® Neut | 3 | 3 | | | |
| Dequest 2010 ® | | | | | |
| Dequest 2016 ® | | | | | |
| Neutralized Dequest ® | | | | | |
| Dowfax 3B2 ® | | | | | |
| EO/PO Surfactant 1 | | | 1 | 1 | 1 |
| EO/PO Surfactant 2 | 1 | | | | |
| EO/PO Surfactant 3 | 1 | | | | |
| Bz-EOx-R | | | | | |
| LAS Flake ® | | | | | |
| Goodrite 7058ND ™ | | | | | |
| Neodol 25-7 ® | | | | | |
| NPE 9.5 | | | | | |
| Pluronic RA40 ® | | | | | |
| Triton CF-21 ® | | 1 | | | |
| Versene 220 ® | | | 4 | | |
| NTA | | | | 4 | |
| Powered/TPP | | | | | |
| Sm Granular/TPP | | | | | |
| Lg Granular/TPP | | | | | |
| BLEACH | | | | | |
| Ecolab Chlorine | | | | | |
| DILUENT | | | | | |
| Sodium Chloride | 4 | | | | |

TABLE 6

| Processing Data | | | |
|---|---|---|---|
| Trl # | Time* (min) | Temp (° F.) | Rpm |
| 1 | — | — | — |
| 2 | — | — | — |
| 3 | — | — | — |
| 4 | — | — | — |
| 5 | — | — | — |
| 6 | — | — | — |
| 7 | — | 175[1] | — |
| 8 | 0 | — | 300 |
| | 2.58 | 179.6 | 400 |
| 9 | 0 | — | 300 |
| | 4.00 | — | 400 |
| | 14.00 | — | 500 |
| | 22.00 | 200 | 500 |
| | 23.50 | 191 | 500 |
| 10 | 30.00 | 170 | 550 |
| 11 | — | — | 500 |
| 12 | — | — | — |
| 13 | — | — | — |
| 14 | 2.50 | — | 300 |
| | 3.25 | 172 | 300 |
| 15 | 1.00 | — | 700[2] |
| | 3.00 | 183 | 900[3] |

TABLE 6-continued

| Processing Data | | | |
|---|---|---|---|
| Trl # | Time* (min) | Temp (° F.) | Rpm |
| 16 | 3.00 | 184 | 700 |
| 17 | 1.33 | 179 | 700 |
| 18 | 3.00 | 177 | 500 |
| 19 | 2.00 | 198 | 700 |
| 20 | 2.50 | 185 | 700 |
| 21 | 2.75 | 201 | 700 |
| 22 | 1.30 | 200 | 700 |
| 23 | — | — | — |
| 24 | 3.50 | 194 | — |
| 25 | 5.00 | 189 | — |
| 26 | 2.75 | 171 | 700 |
| 27 | 1.50 | — | 500 |
| | 2.00 | — | 500 |
| | 5.00 | 195 | — |
| 28 | 2.50 | — | 700 |
| | 3.00 | — | 700 |
| | 6.00 | 204 | — |
| 29 | 2.00 | — | 700 |
| | 2.50 | 165 | 700 |

*Timing initiated after addition of last component completed.
[1]Maximim temperature attained.
[2]Rpm during addition of components 1, 2 and 3.
[3]Rpm during addition of components 4 and 5.

TABLE 7

| Penetrometer Data | | | |
|---|---|---|---|
| Trl # | Time[4] (min) | Needle Depth (mm) | Comments |
| 1 | — | — | Formed a completely hardened solid product. |
| 2 | — | — | Formed a completely hardened solid product. |
| 3 | — | — | Formed a completely hardened solid product. |
| 4 | — | — | Formed a completely hardened solid product. |
| 5 | — | — | Formed a completely hardened solid product. |
| 6 | — | — | Formed a completely hardened solid product. |
| 7 | — | — | Solidifies in less than 10 minutes. |
| 8 | 1 | 329 | Solidified in less than 10 minutes. |
| | 4 | 142, 60, 36 | |
| | 8 | 4, 8, 12 | |
| | 12 | 3, 2, 4 | |
| | 16 | 2, 0, 3 | |
| | 20 | 0, 0, 0 | |
| | 24 | 2, 0, 0 | |
| | 28 | 2, 1, 8 | |
| 9 | 24 hrs | 0, 0, 0 | Product began to solidify immediately but thinned as the Dequest 2010 ® was added. Formed thick surface skin immediately after completion of agitation. |

[4]Time represents the length of time after all components have been added and agitation has been completed.

| Trl # | Time[5] (min) | Needle Depth (mm) | Comments |
|---|---|---|---|
| 10 | — | — | Completely solidified when checked one hour after completion of agitation. |
| 11 | — | — | Surface solidified within 5 minutes after completion of agitation. Completely solid product removed from the mold 30 minutes after completion of agitation. |
| 12 | — | — | Formed a solid product. |
| 13 | — | — | Formed a solid product. |

TABLE 7-continued

| Penetrometer Data | | | |
|---|---|---|---|
| 14 | — | — | Product still pourable 30 minutes after completion of agitation. Completely solidified 90 minutes after completion of agitation. |
| 15 | — | — | Product is solid 1.5 minutes after completion of agitation and completely hardened 2.5 minutes after completion of agitation. |
| 16 | — | — | Product is solid 0.25 minutes after completion of agitation and removed from mold 15 minutes after completion of agitation. |

[5]Time represents the length of time after all components have been added and agitation has been completed.

| Trl # | Time[6] (min) | Needle Depth (mm) | Comments |
|---|---|---|---|
| 17 | — | — | Product is solid 1 minute after completion of agitation and completely hardened 4 minutes after completion of agitation. |
| 18 | 8.0 | 34, 42, 36 | Product is solid 12 minutes after |
| | 12.0 | 4, 3, 2 | completion of agitation and completely |
| | 16.0 | 2, 0, 0 | hardened 15–16 minutes after |
| | 20.0 | 0, 0, 0 | after completion of agitation. |
| 19 | 1.0 | 11, 3, 4 | Difficult to incorporate component |
| | 3.0 | 0, 0, 4 | 3 premix due to thickness of silicate |
| | 5.0 | 0, 0, 0 | and caustic mixture. |

[6]Time represents the length of time after all components have been added and agitation has been completed.

| Trl # | Time[7] (min) | Needle Depth (mm) | Comments |
|---|---|---|---|
| 20 | 0 | 329 | Component 3 premix readily |
| | 4.0 | 13, 5, 6 | incorporated into mixture of silicate |
| | 8.0 | 0, 0, 0 | and caustic. |
| 21 | 0 | 329 | |
| | 4 | 329 | |
| | 8 | 329 | |
| | 12 | 329 | |
| | 16 | 247, 198, 278 | |
| | 20 | 183, 193, 161 | |
| | 24 | 145, 141, 132 | |
| | 28 | 121, 121, 115 | |
| | 32 | 126, 191, 121 | |
| 22 | 4 | 0, 3, 0 | |
| 23 | — | — | Formed a completely hardened solid product. |
| 24 | — | — | Product solidified very quickly. |
| 25 | — | — | Formed a completely hardened solid product. |
| 26 | 0 | 329 | Product solidified about 16 minutes |
| | 4 | 329 | after after completion of |
| | 8 | 16, 18, 16 | |
| | 12 | 17, 9, 5 | |
| | 16 | 5, 4, 2 | |
| | 20 | 1, 2, 2 | |
| 27 | 0 | 7, 3, 9 | Product became very viscous one |
| | 4 | 5, 1, 3 | minute after completion of agitation |
| | 8 | 1, 2, 1 | and solidified very quickly. |
| 28 | 4 | 0, 0, 0 | Product solidified almost immediately after completion of agitation. |

[7]Time represents the length of time after all components have been added and agitation has been completed.

| Trl # | Time[8] (min) | Needle Depth (mm) | Comments |
|---|---|---|---|
| 29 | 0 | 329+ | Product developed a tough skin about |
| | 4 | 329+ | 25 minutes after completion of agitation |
| | 8 | 329+ | with a viscous center. Appears to be |
| | 12 | 329+ | solidifying from the outside towards the inside. |

[8]Time represents the length of time after all components have been added and agitation has been completed.

Experimental Procedure (Trials 30–57)

The reactants RU Silicate®, water, metasilicate and sodium hydroxide were sequentially placed into a polypropylene container equipped with a laboratory agitator to form a reaction mixture. The proportions of each reactant are set forth in Table 8. The reaction mixture was agitated and then allowed to solidify at room temperature. The maximum temperature attained by the reaction mixture due to an exothermic reaction between the reactants is provided in Table 9. A subjective assessment of the time at which the reaction product solidified is also provided in Table 9.

The decomposition/melt temperature of the solidified reaction product was determined using a Perkin-Elmer Differential Scanning Calorimeter. The hardness of the solidified reaction product was determined in accordance with the penetrometer testing procedure. The relevant data as to the decomposition/melt temperature and the hardness of the solidified reaction product are set forth in Table 9.

TABLE 8

Compositions of Trials Establishing Phase Diagram

| Trl # | RU Si (g) | Meta Si (g) | NaOH (g) | $H_2O$ (g) | % $SiO_2$ | % $Na_2O$ | % $H_2O$ |
|---|---|---|---|---|---|---|---|
| 30 | 44.73 | 14.35 | 40.92 | 0 | 21.91 | 45.20 | 32.89 |
| 31 | 27.37 | 17.84 | 54.73 | 0 | 17.82 | 55.34 | 26.84 |
| 32 | 34.90 | 10.83 | 54.27 | 3.28 | 16.38 | 50.73 | 32.89 |
| 33 | 27.41 | 13.23 | 59.36 | 7.49 | 14.52 | 52.58 | 32.89 |
| 34 | 24.83 | 11.99 | 653.18 | 8.24 | 13.06 | 54.04 | 32.89 |
| 35 | 22.71 | 10.96 | 66.33 | 8.86 | 11.88 | 55.23 | 32.89 |
| 36 | 47.79 | 21.14 | 31.31 | 0.77 | 26.27 | 40.84 | 32.89 |
| 37 | 37.01 | 33.30 | 28.98 | 0.70 | 28.67 | 44.51 | 26.82 |
| 38 | 30.77 | 27.69 | 40.01 | 1.53 | 23.84 | 49.34 | 21.82 |
| 39 | 22.95 | 13.47 | 63.11 | 0.47 | 14.25 | 58.93 | 26.82 |
| 40 | 60.04 | 7.80 | 31.82 | 0.33 | 23.78 | 36.94 | 39.28 |
| 41 | 51.34 | 5.56 | 40.00 | 3.09 | 19.80 | 40.91 | 39.29 |
| 42 | 38.35 | 4.18 | 49.67 | 7.80 | 14.79 | 45.92 | 39.28 |
| 43 | 44.59 | 0 | 51.28 | 4.13 | 14.81 | 45.91 | 39.28 |
| 44 | 35.64 | 0 | 56.71 | 7.65 | 11.84 | 48.88 | 39.28 |
| 45 | 33.77 | 0 | 53.75 | 12.47 | 11.22 | 46.33 | 42.45 |
| 46 | 42.29 | 0 | 48.59 | 9.13 | 14.04 | 43.51 | 42.45 |
| 47 | 56.48 | 0 | 39.97 | 3.55 | 18.76 | 38.79 | 42.45 |
| 48 | 62.56 | 3.71 | 31.49 | 2.24 | 22.60 | 34.95 | 42.45 |
| 49 | 37.53 | 0 | 51.47 | 11.00 | 12.46 | 45.09 | 42.45 |
| 50 | 48.41 | 0 | 44.87 | 6.72 | 16.06 | 41.53 | 42.40 |
| 51 | 40.41 | 0 | 46.44 | 13.15 | 13.42 | 41.58 | 45.00 |
| 52 | 38.21 | 0 | 43.90 | 17.90 | 12.69 | 39.31 | 48.00 |
| 53 | 32.34 | 0 | 58.72 | 8.94 | 10.74 | 49.98 | 39.28 |
| 54 | 30.66 | 0 | 55.65 | 13.69 | 10.18 | 47.37 | 42.45 |
| 55 | 29.29 | 0 | 53.18 | 17.52 | 9.73 | 45.27 | 45.00 |
| 56 | 38.21 | 0 | 43.90 | 21.90 | 12.20 | 37.79 | 50.00 |
| 57 | 37.53 | 0 | 51.47 | 15.63 | 11.91 | 43.09 | 45.00 |

TABLE 9

Experimental Results

| Trl # | Max[9] Temp (° C.) | Solid (Min) | Major DCS Peak (° C.) | Minor DCS Peak (° C.) | Penetrometer Needle Depth (mm) | | |
|---|---|---|---|---|---|---|---|
| 30 | 86.1 | 2 | 141.4 | 62.9 | 1 | 4 | 2 |
| 31 | 65.6 | 20 | 164.5 | 42.5 | 0 | 2 | 0 |
| 32 | 86.7 | 30 | 178.8 | 54.8 | 1 | 0 | 0 |
| 33 | 83.3 | 26 | 176.5 | 39.6 | 0 | 0 | 1 |
| 34 | 73.9 | 22 | 50.4 | — | 4 | 1 | 0 |
| 35 | 70.0 | 48 | 62.7 | — | 0 | 3 | 0 |
| 36 | 76.7 | 12 | 83.2 | — | 0 | 0 | 0 |
| 37 | 71.1 | 6 | 72.5 | 105.0 | 0 | 1 | 1 |

TABLE 9-continued

| | | | Experimental Results | | | | |
|---|---|---|---|---|---|---|---|
| 38 | 87.2 | 1 | 173.2 | 27.0 | 4 | 0 | 1 |
| 39 | 62.2 | 3 | 60.9 | — | 0 | 0 | 0 |
| 40 | 87.8 | 16 | 85.0 | — | 0 | 1 | 0 |
| 41 | 95.0 | 21 | 108.1 | 69.6 | 0 | 3 | 0 |
| 42 | 91.1 | 1 | 159.2 | — | 5 | 1 | 3 |
| 43 | 92.8 | 1 | 159.6 | — | 8 | 3 | 0 |
| 44 | 100.0 | 720 | 161.0 | — | 5 | 2 | 2 |
| 45 | 104.4 | 720 | 171.5 | 23.0 | 22 | 14 | 24 |
| 46 | 95.0 | 6 | 144.0 | — | 36 | 27 | 16 |
| 47 | 96.1 | 720 | 81.4 | — | 0 | 0 | 0 |
| 48 | 97.2 | 720 | 80.3 | — | 0 | 0 | 0 |
| 49 | 95.6 | 2 | 157.2 | — | 6 | 9 | 8 |
| 50 | 96.1 | 10 | 100.5 | 72.4 | 2 | 2 | 5 |
| 51 | 98.9 | 12 | 103.0 | 53.6 | 329 | 329 | 329 |
| 52 | 103.3 | 47 | 112.6 | 64.4 | 329 | 329 | 329 |
| 53 | 99.4 | 44 | 40.4 | 183.5 | 0 | 0 | 0 |
| 54 | 105.0 | — | 23.0 | 178.6 | 329 | 329 | 329 |

[9]Maximum temperature attained by reaction mixture during processing.

| Trl # | Max[10] Temp (° C.) | Solid (Min) | Major DCS Peak (° C.) | Minor DCS Peak (° C.) | Penetrometer Needle Depth (mm) | | |
|---|---|---|---|---|---|---|---|
| 55 | 102.2 | 22 | 164.9 | — | 21 | 17 | 24 |
| 56 | 102.8 | — | 73.9 | — | 329 | 329 | 329 |
| 57 | 96.1 | 6 | 147.5 | 48.3 | 22 | 32 | 53 |

[10]Maximum temperature attained by reaction mixture during processing.

Experimental Procedure

(Trials 60–75)

The powder premix portion of the formula as set forth in Table 10 was blended in a ribbon mixer. The liquid premix portion of the formula as set forth in Table 10 was blended in a mix tank with the RU silicate added first and the temperature of the liquid premix adjusted as set forth in Table 11.

The powder and liquid premixes were blended in a Teledyne-Readco continuous mixer with the powder premix fed through an Acrison portable volumetric feeder and the liquid premix fed through a Bran-Lubbe piston metering pump. The feed rate of the powdered and liquid premixes, the mixing rate and the temperature of the product upon exiting the T-R mixer are set forth in Table 11.

The Teledyne-Readco continuous mixer was equipped with 24 sets of 2 inch diameter, lens-shaped paddles having variable shapes and configurations designed to achieve either forward or reverse conveying in combination with sheer conveying sections proximate to the inlet orifice to the mixture. The mixer provided close tolerance between the paddles and the jacket.

The rate at which a solidified product of Formulas #2 and #3 may be dispensed in a spray-type dispenser is set forth in Table 12.

TABLE 10

| | Processing Formulas (wt) | | | |
|---|---|---|---|---|
| | Frml #1 | Frml #2 | Frml #3 | Frml #4 |
| Powder Premix | | | | |
| Sodium Netasilicate | 10.6 | 10.6 | 10.5 | 10.5 |
| Sodium Hydroxide Bead | 30.3 | 27.3 | 30.0 | 27.1 |
| Acrysol LMW-45ND | 14.1 | 14.1 | 14.1 | 14.1 |

TABLE 10-continued

| | Processing Formulas (wt) | | | |
|---|---|---|---|---|
| | Frml #1 | Frml #2 | Frml #3 | Frml #4 |
| Liquid Premix | | | | |
| RU Silicate | 33.1 | 33.1 | 32.8 | 32.8 |
| Sodium Hydroxide | — | 2.9 | — | 2.9 |
| Bayhibit PB AM Neut | 9.3 | 9.3 | 9.3 | 9.3 |
| EO/PO Surfactant 1 | 2.6 | 2.7 | — | — |
| Surfactant 2 | — | — | 1.1 | 1.1 |
| Surfactant 3 | — | — | 2.2 | 2.2 |

TABLE 11

| | Processing Data | | | | |
|---|---|---|---|---|---|
| Trial # | Formula # | Liquid (° C.) | Feed Rate (kg/min) | Mix Rate (rpm) | End Temp (° C.) |
| 60 | 1 | 26.7 | 3.74 | 116 | 63.3 |
| 61 | 1 | 26.7 | 3.74 | 220 | 63.9 |
| 62 | 1 | 26.7 | 7.48 | 158 | 62.2 |
| 63 | 1 | 26.7 | 7.48 | 220 | 63.9 |
| 64 | 2 | 54.5 | 3.74 | 116 | 58.9 |
| 65 | 2 | 54.5 | 3.74 | 220 | 60.0 |
| 66 | 2 | 26.7 | 3.74 | 116 | 45.0 |
| 67 | 2 | 26.7 | 3.74 | 220 | 47.2 |
| 68 | 3 | 54.5 | 3.74 | 116 | 77.5 |
| 69 | 3 | 54.5 | 3.74 | 220 | 77.2 |
| 70 | 3 | 54.5 | 7.48 | 158 | 71.1 |
| 71 | 3 | 54.5 | 7.48 | 220 | 76.7 |
| 72 | 4 | 54.5 | 7.48 | 158 | 48.9 |
| 73 | 4 | 54.5 | 7.48 | 220 | 50.0 |
| 74 | 4 | 26.7 | 7.48 | 158 | 48.3 |
| 75 | 4 | 26.7 | 7.48 | 220 | 48.3 |

Testing Procedures

Dispensing Rate

The dispensing rates of the reaction products obtained from Trials #30 and #31 were tested in a Guardian System™ spray-type, detergent reservoir dispenser, manufactured by Ecolab, Incorporated under U.S. Pat. No. 4,063,663 at a line pressure of 35 psig and a water temperature of 50–55° C. in accordance with the procedure set forth below.

Step 1—Weigh fresh capsule.

Step 2—Precondition composition by placing the capsule in the dispenser and contacting the exposed surface of the composition with a water spray for one minute.

Step 3—Remove capsule from the dispenser and allow the capsule to stand inverted for one minute. Weigh any composition which drips from the capsule after removal of the capsule from the dispenser.

Step 4—Weigh the capsule.

Step 5—Replace capsule into the dispenser and dispense for one minute.

Step 6—Remove capsule from the dispenser and allow the capsule to stand inverted for one minute. Weigh any composition which drips from the capsule after removal of the capsule from the dispenser.

Step 7—Weigh the capsule.

Step 8—Calculate the initial dispensing rate by subtracting the sum of the weight of the capsule in step seven and the weight of the composition which dripped from the capsule in step six from the weight of the capsule in step four and then dividing the subtotal by one minute.

Step 8—Replace capsule into the dispenser and dispense for four minutes.

Step 9—Remove capsule from the dispenser and allow the capsule to stand inverted for one minute. Weigh any composition which drips from the capsule after removal of the capsule from the dispenser.

Step 10—Weigh the capsule.

Step 11—Calculate the intermediate dispensing rate by subtracting the sum of the weight of the capsule in step ten and the weight of the composition which dripped from the capsule in step nine from the weight of the capsule in step seven and then dividing the subtotal by four minutes.

Step 12—Replace capsule into the dispenser and dispense for four minutes.

Step 13—Remove capsule from the dispenser and allow the capsule to stand inverted for one minute. Weigh any composition which drips from the capsule after removal of the capsule from the dispenser.

Step 14—Weigh the capsule.

Step 11—Calculate the final dispensing rate by subtracting the sum of the weight of the capsule in step fourteen and the weight of the composition which dripped from the capsule in steps six, nine and thirteen from the weight of the capsule in step ten and then dividing the subtotal by four minutes.

Step 12—Calculate the overall dispensing rate by subtracting the sum of the weight of the capsule in step fourteen and the weight of the composition which dripped from the capsule in steps thirteen from the weight of the capsule in step four and then dividing the subtotal by nine minutes.

TABLE 12

| | Dispensing Rate | | | | |
|---|---|---|---|---|---|
| Frml # | Initial (g/min) | Middle (g/min) | Final (g/min) | Average (g/min) | Nozzle Type |
| 2 | 163 | 132 | 106 | 124 | 1 |
| 3 | 140 | 114 | 87 | 105 | 1 |
| 2 | 135 | 170 | 221 | 189 | 2 |
| 2 | 116 | 169 | 205 | 179 | 2 |
| 3 | 113 | 139 | 161 | 146 | 2 |
| 3 | 102 | 127 | 167 | 142 | 2 |
| 3 | 110 | 126 | 166 | 142 | 2 |

Nozzle Type 1 - Whirl Jet, one-eighth inch, model 8W, Wide Angle manufactured by Spraying Systems.
Nozzle Type 2 - Full Cone, one-eighth inch, model 3.5, Narrow Angle manufactured by Spraying Systems.

Precipitate Inhibition Test

Various combinations of polymeric organic acids and phosphonates were evaluated for their ability to control the precipitation of calcium and magnesium at threshold levels in accordance with the procedure set forth below.

Step 1—Set hot water bath at 70° C. and allow to equilibrate.

Step 2—Wash five eight-ounce, wide-mouth, glass bottles with a 10% nitric acid solution, rinse with tap water, rinse with distilled water and then allow to air dry.

Step 3—Prepare solutions of the organic acids, phosphonates, silicates and carbonates which are to be used in the test in separate volumetric flasks.

Step 4—Test water for hardness in accordance with the hardness concentration test set forth below. Record the hardness of the water (control).

Step 5—Label the bottle caps.

Step 6—Place ninety-nine milliliters of the water in each bottle and then sequentially add the indicated amounts of threshold agent monomer(s), threshold agent polymer(s), sodium silicate, and sodium carbonate as set forth in Tables 13 through 27 using the appropriate stock solutions created in step three.

Step 7—Adjust the pH of the solution in each bottle to between 11.4 to 11.6 by adding either about a 15% solution of NaOH or about a 15% solution of HCl as appropriate.

Step 8—Tightly cap the bottles with the labeled caps, shake the bottles to facilitate dissolution of the added components, and then place the bottles in the water bath for 2 hours.

Step 9—Withdraw approximately twenty milliliters of the solution in each bottle-with a syringe and filter the withdrawn samples through a Millipore filter system (Catalog #SX00002500) manufactured by The Millipore Corporation using a Type HA Millipore filter having a 0.45 micron pore size. Place the filtrate into a correspondingly labeled test tube.

Step 10—Test the five filtrate samples for concentrations of calcium, magnesium and sodium ions remaining in the solution in accordance with the hardness concentration test set forth below. Record the concentration of each ion in each solution.

Results

The data obtained are set forth in Tables 13 through 27. The test was repeated five times for each threshold system. Table 13 provides the details for each test while subsequent tables provide only the average of the five tests for each system.

The data clearly demonstrates that a synergistic effect for controlling both calcium and magnesium is achieved by a combination of a polyacrylate of the proper molecular weight, a phosphonate-type compound and a silicate. Effective control of both of these ions is essential for obtaining good dishwashing results.

It should be noted that in this and all subsequent tables (Tables 13 through 27) all testing was done in the presence of 400 ppm of added $Na_2CO_3$. This is added to give a constant high level of carbonate to insure a high tendency for the precipitation of calcium carbonate.

Testing Procedure

Cation Concentration Test

The individual concentrations of calcium, magnesium and sodium in the aqueous filtrates obtained in the precipitation test were obtained using a Leeman Labs Plasma Spec ICP in accordance with the standard protocol for operation of the unit and the procedures set forth below. The concentrations of calcium and magnesium in the filtrates indicates the effectiveness of the various threshold systems to prevent precipitation of these ions. (The greater the concentration of ions in the filtrate the greater the effectiveness of the threshold system).

Because the samples generally contain a silicate, the samples may not be preserved as addition of a preservative acid causes the formation of a precipitate which interferes with the analysis. Accordingly, analysis of the samples was conducted by Inductively Coupled Plasma Spectroscopy (ICP) within a few hours of filtration.

Preparation of Standardized Reagents

Prepare the standard individual solutions set forth below:

| | |
|---|---|
| Calcium | 1000 ppm |
| Magnesium | 1000 ppm |
| Sodium | 1000 ppm |
| $HNO_3$ | concentrated |
| HCl | concentrated |

Prepare five standard mixed solutions for calibrating the ICP as set forth in Table A by (i) adding the indicated volume of each of the standard individual solutions to a one liter volumetric flask containing approximately 200 milliliters of Millipore DI water, (ii) adding 5.0 milliliters of the $HNO_3$ solution and 5.0 milliliters of the HCL solution to the volumetric flask, and then (iii) adding sufficient additional Millipore DI water to produce 1000 milliliters of standard mixed solution. These standards are stable for 2 months.

TABLE A

| Standard Solution | Solution[1] (blank) | Solution[2] (ml) | Solution[3] (ml) | Solution[4] (ml) | Solution[5] (ml) |
|---|---|---|---|---|---|
| Ca | 0 | 1 | 10 | 50 | 100 |
| Mg | 0 | 1 | 10 | 50 | 100 |
| Na | 0 | 10 | 50 | 150 | 300 |

Obtain an ampule containing a certified concentration from EPA, Cincinnati, Ohio and prepare as instructed. The prepared solution is to be used as a check standard (external).

Prepare an internal mixed solution in the same manner set forth for preparation of the standard mixed solutions using 40 milliliters of the Ca, 40 milliliters of the Mg, and 50 milliliters of the Na standard individual solutions. The prepared solution is also to be used as a check standard (internal).

TABLE 13

Precipitate Inhibition Test

| No. | Deq ppm | PAA[1] ppm | Sil[1] ppm | Carb ppm | Ca ppm | Mg ppm | Na ppm | pH* |
|---|---|---|---|---|---|---|---|---|
| Ctrl | | | | | | 61.1 | 23.8 | 4.3 |
| 1 | — | — | — | 400 | 1.0 | 1.0 | 445 | 11.5 |
| 2 | — | — | — | 400 | 1.0 | 1.0 | 446 | 11.6 |
| 3 | — | — | — | 400 | 1.0 | 1.0 | 449 | 11.5 |
| 4 | — | — | — | 400 | 1.0 | 1.0 | 416 | 11.4 |
| 5 | — | — | — | 400 | 1.0 | 1.0 | 477 | 11.6 |
| | | | Average | | 1.0 | 1.0 | 447 | |
| 6 | 15 | 60 | 400 | 400 | 58.1 | 22.4 | 530 | 11.4 |
| 7 | 15 | 60 | 400 | 400 | 56.1 | 21.7 | 528 | |
| 7 | ** | 60 | 400 | 400 | 55.5 | 20.3 | 539 | |
| 8 | 15 | 60 | 400 | 400 | 56.5 | 21.6 | 535 | 11.4 |
| 9 | 15 | 60 | 400 | 400 | 52.4 | 18.9 | 509 | 11.4 |
| 10 | 15 | 60 | 400 | 400 | 56.2 | 21.2 | 531 | 11.4 |
| | | | Average | | 55.8 | 21.0 | 529 | |
| 11 | 15 | 60 | — | 400 | 43.8 | 18.5 | 465 | 11.5 |
| 12 | 15 | 60 | — | 400 | 46.3 | 22.0 | 410 | |
| 12 | ** | 60 | — | 400 | 21.9 | 4.1 | 419 | |
| 13 | 15 | 60 | — | 400 | 47.1 | 22.5 | 419 | 11.3 |
| 14 | 15 | 60 | — | 400 | 48.0 | 22.1 | 432 | 11.4 |
| 15 | 15 | 60 | — | 400 | 46.7 | 20.9 | 425 | 11.3 |
| | | | Average | | 42.3 | 18.4 | 428 | |
| 16 | 15 | — | 400 | 400 | 20.7 | 1.0 | 513 | 11.4 |
| 17 | 15 | — | 400 | 400 | 21.3 | 1.0 | 419 | 11.3 |
| 18 | 15 | — | 400 | 400 | 20.9 | 1.0 | 507 | 11.4 |
| 19 | 15 | — | 400 | 400 | 20.4 | 1.0 | 518 | 11.4 |
| 20 | 15 | — | 400 | 400 | 21.4 | 1.0 | 497 | 11.4 |
| | | | Average | | 20.9 | 1.0 | 491 | |
| 21 | — | 60 | 400 | 400 | 14.2 | 23.3 | 542 | 11.5 |
| 22 | — | 60 | 400 | 400 | 14.7 | 23.6 | 538 | 11.5 |
| 23 | — | 60 | 400 | 400 | 14.7 | 23.6 | 522 | 11.4 |
| 24 | — | 60 | 400 | 400 | 14.8 | 23.7 | 515 | 11.4 |
| 25 | — | 50 | 400 | 400 | 14.8 | 23.4 | 533 | 11.5 |
| | | | Average | | 14.6 | 23.5 | 530 | |
| 26 | 15 | — | — | 400 | 16.3 | 1.0 | 400 | 11.5 |
| 27 | 15 | — | — | 400 | 17.3 | 1.0 | 408 | 11.4 |
| 28 | 15 | — | — | 400 | 17.2 | 1.0 | 416 | 11.3 |
| 29 | 15 | — | — | 400 | 17.2 | 1.0 | 402 | 11.4 |
| 30 | 15 | — | — | 400 | 17.0 | 1.0 | 409 | 11.4 |
| | | | Average | | 17.0 | 1.0 | 415 | |

TABLE 13-continued

Precipitate Inhibition Test

| No. | Deq ppm | PAA[1] ppm | Sil[1] ppm | Carb ppm | Ca ppm | Mg ppm | Na ppm | pH* |
|---|---|---|---|---|---|---|---|---|
| 31 | — | 60 | — | 400 | 11.7 | 22.7 | 469 | 11.5 |
| 32 | — | 60 | — | 400 | 11.8 | 22.9 | 460 | 11.5 |
| 33 | — | 60 | — | 400 | 11.8 | 23.1 | 451 | 11.4 |
| 34 | — | 60 | — | 400 | 12.0 | 23.0 | 455 | 11.4 |
| 35 | — | 60 | — | 400 | 11.9 | 22.8 | 454 | 11.4 |
| | | | Average | | 11.8 | 22.9 | 458 | |
| 36 | — | — | 400 | 400 | 2.1 | 10.9 | 522 | 11.5 |
| 37 | — | — | 400 | 400 | 2.3 | 13.3 | 539 | 11.5 |
| 38 | — | — | 400 | 400 | 1.8 | 8.2 | 542 | 11.5 |
| 39 | — | — | 400 | 400 | 2.2 | 14.7 | 541 | 11.5 |
| 40 | — | — | 400 | 400 | 2.3 | 14.4 | 546 | 11.4 |
| | | | Average | | 2.1 | 12.3 | 538 | |

*After Filtration
**After 24 Hours

Conclusions

The concentration of threshold agents in the systems of Table 13 were selected to stress the system (calcium and magnesium barely being controlled when all three of the threshold agents were present). Much of the subsequent testing was done at higher levels of threshold agents so as to more accurately depict actual dishwashing use conditions.

Table 13 indicates:

The phosphonate (Dequest 2010™) is ineffective for suspending magnesium and suspends only one-fourth of the calcium at a concentration of 15 ppm when used alone.

The polyacrylate (PAA[1]) is effective for suspending magnesium but suspends only about one-fifth of the calcium at a concentration of 60 ppm when used alone.

The silicate (Sil[1]) is ineffective for suspending calcium and suspends only one-half of the magnesium at a concentration of 400 ppm when used alone.

A combination of phosphonate (Dequest 2010™) and silicate (Sil[1]) is ineffective for suspending magnesium and suspends only one-third of the calcium despite the fact that the silicate is capable of suspending one-half of the magnesium when used alone. The phosphonate appears to inhibit the ability of the silicate to suspend magnesium.

A combination of polyacrylate (PAA[1]) and silicate (Sil[1]) is effective for suspending magnesium but suspends only about one-fourth of the calcium despite the fact that the silicate is capable of suspending one-half of the magnesium when used alone.

A combination of phosphonate (Dequest 2010™), polyacrylate (PAA[1]) and silicate (Sil[1]) is effective for suspending magnesium and calcium. A sum of the individual components would predict an ineffective suspension of magnesium (inhibitory effect of phosphonate upon silicate) and poor suspension of calcium.

It is noted for completeness that the results obtained from the binary system of a phosphonate and a polyacrylate was not included in the analysis as the silicate is a necessary component of the detergent composition into which the threshold system is employed and will therefore always be present.

TABLE 14

| Nos. | Deq. 2010 ppm | PAA[1] ppm | Sil[1] ppm | Ca | Mg | pH |
|---|---|---|---|---|---|---|
| 1–5 | — | — | — | <1.0 | <1.0 | 11.3 |
| 6–10 | 20 | — | — | 23.0 | .3 | 11.2 |
| 11–15 | — | 80 | — | 15.6 | 19.8 | 11.2 |
| 16–20 | — | — | 400 | 1.4 | 10.0 | 11.3 |
| 21–25 | 20 | 80 | — | 52.8 | 18.6 | 11.4 |
| 26–30 | — | 80 | 400 | 15.7 | 21.0 | 11.3 |
| 31–35 | 20 | — | 400 | 21.7 | <1.0 | 11.3 |
| 36–40 | 20 | 80 | 400 | 51.7 | 20.91 | 11.4 |
| CONTROL | | | | 55.6 | 23.6 | |

Conclusions

Concentration of Dequest 2010™ and PAA[1] was increased with respect to the concentrations employed in Table 13. At these higher levels both the binary system of Dequest 2010™ and PAA[1] (Nos. 21–25) and the tertiary system of Dequest 2010™, PAA[1] and Sil[1] (Nos. 36–40) provide effective control. This would not be expected from the sum of the individual component tests.

TABLE 15

| Nos. | Deq 2010 (ppm) | LMW 10N (ppm) | LMW 100N (ppm) | PAA[1] (ppm) | Ca (ppm) | Mg (ppm) | pH |
|---|---|---|---|---|---|---|---|
| 1–5 | — | 80 | — | — | 5.8 | 9.5 | 11.2 |
| 6–10 | — | — | 80 | — | 11.3 | 20.5 | 11.4 |
| 11–15 | — | 80 | — | 80 | 17.4 | 21.7 | 11.5 |
| 16–20 | 20 | 80 | — | — | 30.0 | <1.0 | 11.2 |
| 21–25 | 20 | — | 80 | — | 39.3 | 10.5 | 11.3 |
| 26–30 | 20 | — | — | 80 | 54.8 | 20.4 | 11.2 |
| 31–35 | 20 | 60 | — | 20 | 30.2 | 1.3 | 11.3 |
| 35–40 | 20 | — | 60 | 20 | 47.5 | 14.9 | 11.3 |
| CON-TROL | | | | | 59.9 | 22.3 | |

Conclusions

A polyacrylate having an average molecular weight of about 1000 (LMW 10N™) provides significantly poorer calcium control and slightly. poorer magnesium control than obtained with a polyacrylate having an average molecular weight of about 5,000 (PAA[1]) when used alone.

A polyacrylate having an average molecular weight of about 10000 (LMW 100N™) provides significantly poorer calcium control and about the same magnesium control as obtained with a polyacrylate having an average molecular weight of about 5,000 (PAA[1]) when used alone.

Addition of a phosphonate (Dequest 2010™) to the low molecular weight polyacrylate (LMW 10N™) and the high molecular weight polyacrylate (LMW 10N™) results in a decrease in the ability of the polyacrylate to control magnesium. This is not observed when Dequest 2010™ is added to the intermediate molecular weight polyacrylate (PAA[1]).

TABLE 16

| Nos. | ByHbt ppm | PAA[1] ppm | Sil[1] ppm | Ca | Mg | pH |
|---|---|---|---|---|---|---|
| 1–5 | — | — | — | <1.0 | <1.0 | 11.2 |
| 5–10 | 20 | — | — | 43.7 | 1.8 | 11.3 |
| 11–15 | — | 80 | — | 14.0 | 19.5 | 11.3 |
| 16–20 | — | — | 400 | 1.4 | 13.1 | 11.3 |
| 21–25 | 20 | 80 | — | 56.5 | 21.1 | 11.1 |
| 26–30 | — | 80 | 400 | 13.7 | 20.1 | 11.0 |
| 31–35 | 20 | — | 400 | 31.4 | 1.0 | 11.1 |
| 36–40 | 20 | 80 | 400 | 54.8 | 20.1 | 11.0 |
| CONTROL | | | | 56.8 | 21.0 | |

Conclusions

The phosphonate Bayhibit PB AM™ (2-phosphonobutane-1,2,4-tri-carboxylic acid), performs substantially the same as Dequest 2010™.

TABLE 17

| Nos. | Deq 2010 (ppm) | PAA[1] (ppm) | PAa[2] (ppm) | PAA[3] (ppm) | Sil[1] (ppm) | Ca (ppm) | Mg (ppm) | pH |
|---|---|---|---|---|---|---|---|---|
| 1–5 | 10 | 40 | — | — | 400 | 38.7 | 10.5 | 11.6 |
| 6–10 | 10 | — | 40 | — | 400 | 27.5 | 1.8 | 11.5 |
| 11–15 | 10 | — | — | 40 | 400 | 27.1 | 2.3 | 11.5 |
| 16–20 | 10 | 40 | — | — | — | 26.9 | 1.7 | 11.5 |
| 21–25 | 10 | — | 40 | — | — | 19.5 | <1.0 | 11.5 |
| 26–30 | 10 | — | — | 40 | — | 22.2 | <1.0 | 11.5 |
| CONTROL | | | | | | 63.7 | 25.4 | |

Conclusions

A polyacrylate having a molecular weight of about 5,000 (PAA[1]) performs better in the ternary combination than a copolymer of acrylic acid and itaconic acid (PAA[2]) and better than a polyacrylate having a molecular weight of about 10,000 (PAA[3]).

TABLE 18

| Nos. | Deq 2010 (ppm) | ALCO 149 (ppm) | ALCO 175 (ppm) | BEL 161 (ppm) | Sil[1] (ppm) | Ca (ppm) | Mg (ppm) | pH |
|---|---|---|---|---|---|---|---|---|
| 1–5 | 10 | 40 | — | — | 400 | 23.5 | <1.0 | 11.4 |
| 6–10 | 10 | — | 40 | — | 400 | 17.8 | <1.0 | 11.4 |
| 11–15 | 10 | — | — | 40 | 400 | 22.4 | <1.0 | 11.4 |
| 16–20 | 10 | 40 | — | — | — | 20.3 | <1.0 | 11.3 |
| 21–25 | 10 | — | 40 | — | — | 11.7 | <1.0 | 11.4 |
| 26–30 | 10 | — | — | 40 | — | 23.0 | <1.0 | — |
| CONTROL | | | | | | 60.0 | 23.7 | |

Conclusions

A polyacrylate having a molecular weight of about 5,000 (PAA[1;Table 17]) performs better in the ternary combination than a polyacrylate having a molecular weight of about 2,000 (Alcosperse 149™), better than a copolymer of acrylic acid and maleic anhydride (Alcosperse 175™), and better than a polyacrylate containing phosphono groups and having a molecular weight of about 4,000 (Belsperse 161™).

TABLE 19

| Nos. | Deq 2010 ppm | PAA[2] ppm | Sil[1] ppm | Ca (ppm) | Mg (ppm) | pH |
|---|---|---|---|---|---|---|
| 1–5 | 20 | 80 | 400 | 28.9 | 4.9 | 11.4 |
| 6–10 | 20 | 80 | 200 | 26.3 | <1.0 | 11.0 |
| 11–15 | 20 | 80 | — | 26.1 | 1.8 | 10.9 |
| 16–20 | 15 | 60 | 400 | 25.6 | <1.0 | 11.0 |
| 21–25 | 15 | 60 | 200 | 27.9 | 1.3 | 11.1 |
| 26–30 | 15 | 60 | — | 22.0 | <1.0 | 11.3 |
| CONTROL | | | | 65.3 | 25.2 | |

Conclusions

A ternary combination employing a copolymer of acrylic acid and itaconic acid having a molecular weight of approximately 8000 (PAA[2]) is ineffective for controlling the precipitation of magnesium and controls the precipitation of only about one half of the calcium even at relatively high concentrations.

TABLE 20

| Nos. | Deq 2010 ppm | PAA[1] ppm | Sil[1] ppm | Ca (ppm) | Mg (ppm) | pH |
|---|---|---|---|---|---|---|
| 1–5 | 20 | 80 | 400 | 62.9 | 22.5 | 11.3 |
| 6–10 | 20 | 80 | 200 | 62.1 | 21.3 | 11.1 |
| 11–15 | 20 | 80 | — | 63.6 | 21.4 | 11.3 |
| 16–20 | 15 | 60 | 400 | 51.5 | 14.7 | 11.2 |
| 21–25 | 15 | 60 | 200 | 41.1 | 6.4 | 11.1 |
| 26–30 | 15 | 60 | — | 40.1 | 9.3 | 11.2 |
| CONTROL | | | | 68.3 | 23.7 | |

Conclusions

Various concentrations of Dequest 2010™, PAA[1], and Sil[1] in the ternary combination provide satisfactory control of both calcium and magnesium. The beneficial effect obtained from incorporation of Sil[1] is demonstrated at the lower levels of Dequest 2010™ and PAA[1].

TABLE 21

| Nos. | Deq 2010 ppm | PAA[3] ppm | Sil[1] ppm | Ca (ppm) | Mg (ppm) | pH |
|---|---|---|---|---|---|---|
| 1–5 | 20 | 80 | 400 | 54.7 | 18.7 | 1.3 |
| 6–10 | 20 | 80 | 200 | 51.9 | 16.8 | 11.4 |
| 11–15 | 20 | 80 | — | 38.4 | 8.0 | 11.4 |
| 16–20 | 15 | 60 | 400 | 26.6 | 3.0 | 11.5 |

TABLE 21-continued

| Nos. | Deq 2010 ppm | PAA[3] ppm | Sil[1] ppm | Ca (ppm) | Mg (ppm) | pH |
|---|---|---|---|---|---|---|
| 21–25 | 15 | 60 | 200 | 25.6 | 2.4 | 11.5 |
| 26–30 | 15 | 60 | — | 26.2 | 1.2 | 11.4 |
| CONTROL | | | | 62.4 | 24.9 | |

Conclusions

A polyacrylate having an average molecular weight of about 10,000 (PAA[3]) is effective in the ternary combination for controlling both calcium and magnesium when used at higher concentration levels but appears to be less effective than a polyacrylate having an average molecular weight of about 5,000 (PAA[1];Table 20).

TABLE 22

| Nos. | DCDPP ppm | PAA[1] ppm | Sil[1] ppm | Ca (ppm) | Mg (ppm) | pH |
|---|---|---|---|---|---|---|
| 1–5 | 10 | — | — | 3.4 | 1.0 | |
| 6–10 | 20 | — | — | 14.3 | 1.0 | |
| 11–15 | 15 | 60 | — | 37.6 | 21.4 | |
| 16–20 | 15 | 60 | 400 | 52.8 | 20.3 | |
| 21–25 | 20 | 80 | — | 61.3 | 24.5 | |
| 26–30 | 20 | 80 | 400 | 60.5 | 23.6 | |
| CONTROL | | | | 66.4 | 25.5 | |

Conclusions

The phosphonate 1,5-dicarboxy 3,3-diphosphono pentane (DCDPP), performs substantially the same as Dequest 2010™. The beneficial effect obtained from incorporation of Sil[1] is demonstrated at the lower levels of Dequest 2010™ and DCDPP.

TABLE 23

| Nos. | Deq 2010 (ppm) | ALCO 175 (ppm) | PAA[1] (ppm) | Sil[1] (ppm) | Ca (ppm) | Mg (ppm) | pH |
|---|---|---|---|---|---|---|---|
| 1–5 | 20 | — | 80 | 400 | 57.7 | 21.9 | 11.4 |
| 6–10 | 10 | 40 | — | 400 | 19.0 | 1.0 | 11.4 |
| 11–15 | 20 | 80 | — | 400 | 21.9 | 1.0 | 11.5 |
| 16–20 | — | 80 | — | 400 | 7.6 | 4.6 | 11.5 |
| 21–25 | 20 | — | — | 400 | 22.9 | 1.0 | 11.4 |
| 26–30 | — | — | 80 | 400 | 17.3 | 23.1 | 11.4 |
| CONTROL | | | | | 61.1 | 23.7 | |

Conclusions

A ternary combination employing a polyacrylate having an average molecular weight of about 5,000 (PAA[1]) is more effective for controlling both calcium and magnesium than a ternary combination employing a ring opened copolymer of acrylic acid and maleic anhydride having a molecular weight of about 20,000 (Alcosperse 175™). Ternary combinations employing Alcosperse 175™ are only partially effective for controlling calcium and ineffective for controlling magnesium.

TABLE 24

| Nos. | Deq 2010 (ppm) | 7058D (ppm) | PAA[1] (ppm) | Sil[1] (ppm) | Ca (ppm) | Mg (ppm) | pH* |
|---|---|---|---|---|---|---|---|
| 1–5 | 15 | 60 | — | 400 | 35.6 | 9.3 | |
| 6–10 | 15 | 60 | — | — | 28.5 | 1.5 | |
| 11–15 | 20 | 80 | — | 400 | 42.0 | 13.8 | |
| 16–20 | 20 | 80 | — | 200 | 38.8 | 10.2 | |
| 21–25 | 20 | 80 | — | — | 31.5 | 2.2 | |
| 26–30 | 20 | — | 80 | 400 | 55.8 | 23.3 | |
| CONTROL | | | | | 61.0 | 25.8 | |

Conclusions

A ternary combination employing a polyacrylate having an average molecular weight of about 5,000 (PAA[1]) is more effective for controlling both calcium and magnesium than a ternary combination employing a powdered salt of a granular polyacrylic acid having a molecular weight of about 6000 (Goodright 7058D™). However, it is noted that the inclusion of silicate to the binary combination of Goodright 7058D™ and Dequest 2010™ significantly improves magnesium control.

TABLE 25

| Nos. | Deq 2010 ppm | PAA[1] ppm | Sil[1] ppm | Ca (ppm) | Mg (ppm) | pH |
|---|---|---|---|---|---|---|
| 1–5 | 20 | 80 | 400 | 17.6 | 10.6 | 11.5 |
| 6–10 | 10 | 40 | 200 | 17.0 | 10.9 | 11.3 |
| 11–15 | 5 | 20 | 100 | 16.5 | 10.5 | 11.4 |
| 16–20 | 2.5 | 10 | 50 | 15.2 | 2.4 | 11.4 |
| 21–25 | 1.25 | 5 | 25 | 9.3 | 1.0 | 11.1 |
| 26–30 | 0.625 | 2.5 | 12.5 | 4.4 | 1.0 | 11.2 |
| CONTROL | | | | 17.1 | 10.9 | |

Conclusions

The ternary combination of Dequest 2010™, PAA[1] and Sil[1] is effective for controlling both calcium and magnesium at reduced concentrations when the concentration of calcium and magnesium has been reduced by softening the water.

TABLE 26

| Nos. | Deq 2010 (ppm) | CY P-35 (ppm) | PAA[1] (ppm) | Sil[1] (ppm) | Ca (ppm) | Mg (ppm) | pH* |
|---|---|---|---|---|---|---|---|
| 1–5 | 20 | — | 80 | 400 | 55.0 | 21.2 | 11.4 |
| 6–10 | 20 | 80 | — | 400 | 36.1 | 7.8 | 11.4 |
| 11–15 | 20 | 80 | — | — | 27.3 | 2.2 | 11.4 |
| 16–20 | 15 | 60 | — | 400 | 25.4 | 1.6 | 11.4 |
| 21–25 | 15 | 60 | — | — | 25.2 | 2.0 | 11.4 |
| 26–30 | — | 80 | — | 400 | 8.7 | 19.1 | 11.4 |
| 31–35 | — | 80 | — | — | 8.6 | 17.9 | 11.4 |
| 36–40 | — | 60 | — | — | 7.7 | 13.6 | 11.2 |
| CONTROL | | | | | 57.8 | 22.2 | |

Conclusions

Cyanamer P-35™, a polyacrylamide, is not as effective as PAA[1] in the ternary combination but does appear to possess some effectiveness for controlling magnesium when used alone.

TABLE 27

| Nos. | Deq 2010 (ppm) | PAA[1] (ppm) | Sil[2] (ppm) | Ca (ppm) | Mg (ppm) | pH* |
|---|---|---|---|---|---|---|
| 1–5 | 10 | 40 | 400 | 21.6 | 1.1 | 11.6 |
| 6–10 | 10 | 40 | 200 | 21.9 | 1.0 | 11.5 |
| 11–15 | 15 | 60 | 400 | 40.8 | 12.8 | 11.5 |
| 16–20 | 15 | 60 | 200 | 31.2 | 5.3 | 11.6 |
| 21–25 | 20 | 80 | 400 | 57.0 | 22.6 | 11.5 |
| 26–30 | 20 | 80 | 200 | 57.6 | 24.0 | 11.3 |
| CONTROL | | | | 62.9 | 25.8 | |

Conclusions

Ortho Silicate (Sil[2]) is substantially as effective as RU Silicate (Sil[1]) in a ternary system for controlling both calcium and magnesium.

The specification is presented to aid in the complete non-limiting understanding of our invention. Since many variations and embodiments of the invention can be made without departing from the spirit and scope of our invention, our invention resides in the claims hereinafter appended.

We claim:

1. A process for manufacturing an improved solid cast alkaline composition, said process comprising the steps of:

(i) reacting an alkali metal silicate with an alkali metal hydroxide of the formula MOH, wherein M is an alkali metal, in an aqueous environment to form a reaction product; and (ii) solidifying the reaction product in a mold wherein the reaction product is formed and solidified at room temperature without the addition of externally supplied heat and the reaction product solidifies without the use of external cooling; and wherein the relative amount of alkali metal silicate, alkali metal hydroxide and water incorporated into the composition are effective for producing a reaction product having about 20 to 50 parts water per 100 parts of a combination of the alkali metal silicate, the alkali metal hydroxide and water in the cast solid composition and an $M_2O:SiO_2$ ratio of about 2.5:1 to 4.0:1 and M is an alkali metal;

and wherein said process does not result in the deactivation of desirable operative cleaning components.

2. A process for manufacturing an improved solid cast alkaline composition, said process comprising the steps of:

(i) reacting an alkali metal silicate with an alkali metal hydroxide of the formula MOH, wherein M is an alkali metal, in an aqueous environment to form a reaction product; and (ii) solidifying the reaction product in a mold wherein the reaction product is formed and solidified at room temperature without the addition of externally supplied heat and the reaction product solidifies without the use of external cooling; and wherein the relative amount of alkali metal silicate, alkali metal hydroxide and water incorporated into the composition are effective for producing a reaction product having about 20 to 40 parts water per 100 parts of a combination of the alkali metal silicate, the alkali metal hydroxide and water in the cast solid composition and an $M_2O:SiO_2$ ratio of about 1.5:1 to 2.5:1 and M is an alkali metal;

and wherein said process does not result in the deactivation of desirable operative cleaning components.

3. A process for manufacturing an improved solid cast alkaline composition, said process comprising the steps of:

(i) reacting an alkali metal silicate with an alkali metal hydroxide of the formula MOH, wherein M is an alkali metal, in an aqueous environment to form a reaction product; and (ii) solidifying the reaction product in a mold wherein the reaction product is formed and solidified at room temperature without the addition of externally supplied heat and the reaction product solidifies without the use of external cooling; and wherein the relative amount of alkali metal silicate, alkali metal hydroxide and water incorporated into the composition are effective for producing a reaction product having about 20 to 45 parts water per 100 parts of a combination of the alkali metal silicate, the alkali metal hydroxide and water in the cast solid composition and an $M_2O:SiO_2$ ratio of about 2.5:1 to 3.5:1 and M is an alkali metal;

and wherein said process does not result in the deactivation of desirable operative cleaning components.

4. A process for manufacturing an improved solid cast alkaline composition, said process comprising the steps of:

(i) reacting an alkali metal silicate with an alkali metal hydroxide of the formula MOH, wherein M is an alkali metal, in an aqueous environment to form a reaction product; and (ii) solidifying the reaction product in a mold wherein the reaction product is formed and solidified at room temperature without the addition of externally supplied heat and the reaction product solidifies without the use of external cooling; and wherein the alkali metal silicate comprises a first alkali metal silicate having a $M_2O:SiO_2$ ratio between about 1:1.5 and 1:3.8 and a second alkali metal silicate having a $M_2O:SiO_2$ ratio between about 1:1.5 and 1:2.5 and M is an alkali metal, and wherein said process does not result in the deactivation of desirable operative cleaning components.

5. A process for manufacturing an improved solid cast alkaline composition, said process comprising t steps of:

(i) reacting an alkali metal silicate with an alkali metal hydroxide of the formula MOH, wherein M is an alkali metal, in an aqueous environment to form a reaction product; and (ii) solidifying the reaction product in a mold wherein the reaction product is formed and solidified at room temperature without the addition of externally supplied heat and the reaction product solidifies without the use of external cooling; and wherein the alkali metal silicate comprises a sodium silicate having a $Na_2O:SiO_2$ ratio of about 0.1:1and 0.8:1 and a sodium metasilicate, and wherein said process does not result in the deactivation of desirable operative cleaning components.

* * * * *

UNITED STATES PATENT AND TRADEMARK OFFICE

CERTIFICATE OF CORRECTION

PATENT NO. : 6,365,568 B1 
DATED : April 2, 2002
INVENTOR(S) : Olson et al.

It is certified that error appears in the above-identified patent and that said Letters Patent is hereby corrected as shown below:

Title page,
Item [56], References Cited, FOREIGN PATENT DOCUMENTS, insert -- WO 90/12081 10/1990 WIPO -- in appropriate order.

Column 38,
Line 9, "comprising t steps" should read -- comprising the steps --.

Signed and Sealed this

Tenth Day of June, 2003

JAMES E. ROGAN
*Director of the United States Patent and Trademark Office*